US006014923A

United States Patent [19]

Canaday et al.

[11] Patent Number: 6,014,923

[45] **Date of Patent: *Jan. 18, 2000**

[54] SHOULDER-FIRED MULTI-PURPOSE ASSAULT WEAPON

[75] Inventors: Michael M. Canaday, King George; Fred W. Watson, Jr., Montross, both of Va.

[73] Assignee: The United States of America as represented by the Secretary of the Navy, Washington, D.C.

[ * ] Notice: This patent is subject to a terminal disclaimer.

[21] Appl. No.: 08/978,165

[22] Filed: Nov. 25, 1997

Related U.S. Application Data

[60] Division of application No. 08/667,170, Jun. 20, 1996, Pat. No. 5,854,440, which is a continuation-in-part of application No. 08/514,575, Oct. 30, 1995, Pat. No. 5,712,443.

[51] Int. Cl.[7] ..... F41F 3/04; F41A 19/00

[52] U.S. Cl. ..... 89/127; 89/1.816; 42/69.03

[58] Field of Search ..... 42/25, 69.03, 70.01, 42/70.04, 70.05, 105, 100, 101; 89/127, 1.813, 1.816, 142, 148, 1.41, 44.01, 198, 138, 180, 194, 190.01, 190.02

[56] References Cited

U.S. PATENT DOCUMENTS

| | | | |
|---|---|---|---|
| 1,484,163 | 2/1924 | Vincon | 89/149 |
| 2,876,679 | 3/1959 | Dietsch et al. | 89/41 |
| 2,949,825 | 8/1960 | Musser et al. | 89/41 |
| 3,010,369 | 11/1961 | Musser et al. | 89/27.11 |
| 3,098,410 | 7/1963 | Giza | 89/1.7 |
| 3,368,454 | 2/1968 | Peck et al. | 89/1.41 |
| 3,442,173 | 5/1969 | Muller | 89/127 |
| 3,507,067 | 4/1970 | Into | 42/105 |
| 4,038,902 | 8/1977 | Welsh | 89/1.807 |
| 4,195,432 | 4/1980 | Hickman | 42/106 |
| 4,291,479 | 9/1981 | Lough | 42/103 |
| 4,593,602 | 6/1986 | Faix | 89/1.813 |
| 4,867,039 | 9/1989 | Dobbins | 89/127 |
| 5,628,137 | 5/1997 | Cortese | 42/105 |
| 5,712,443 | 1/1998 | Canaday et al. | 89/127 |

FOREIGN PATENT DOCUMENTS

| | | | |
|---|---|---|---|
| 618390 | 3/1927 | France | 42/25 |

OTHER PUBLICATIONS

Excerpt from "Fundamentals of Small Arms Weapons"; STM–SA/PD; U.S. Army Ordinance Center & School, Oct. 1988.

*Primary Examiner*—Charles T. Jordan
*Assistant Examiner*—Christopher K. Montgomery
*Attorney, Agent, or Firm*—James B. Bechtel, Esq.

[57] ABSTRACT

A shoulder-launched multi-purpose assault weapon having a modified spotting rifle with a top-mounted rocket launcher tube is provided. The spotting rifle forms the base structure of the weapon and all weapon controls are located on the rifle. The rifle has several dual-function mechanisms which perform the combined functions of assembly and safing, bolt-locking back and cartridge ejecting, simultaneous adjustment of both open and optical sights, firing, selectively, of both the spotting round and the rocket round. The combination of these dual-firing mechanisms provides a lighter weight, better-balanced and smaller weapon. The reduction in parts count improves reliability and lowers cost. Other improved features include an adjustable spotting rifle barrel used to match the boresight of the rocket tube and an improved locking mechanism. A dual function trigger assembly operated two sears from a single trigger. The primary sear operates a rotating style hammer while the secondary sear operates a plunger-style hammer. The hammers fire, respectively, the spotting rifle and the rocket tube as selected by the gunner.

34 Claims, 30 Drawing Sheets

SHOULDER-FIRED MULTI-PURPOSE ASSAULT WEAPON

This application is a divisional of U.S. patent application Ser. No. 08/667,170 filed Jun. 20, 1996, now U.S. Pat. No. 5,854,440 which is a continuation-in-part of U.S. patent application Ser. No. 08/514,575, Filed Oct. 30, 1995 now U.S. Pat. No. 5,712,443.

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention is related to the technical field of assault weapons and in particular to shoulder-launched rocket weapons.

BACKGROUND OF THE INVENTION

Shoulder-fired assault weapons are well known in the field. The earlier models stem from anti-armor weapons developed during World War II. Since that time, the weapon has evolved into a multi-purpose assault weapon suitable for a variety of targets. These targets include not only armored vehicles, but fixed structures and other types of vehicles. The challenge has been to provide a weapon with multiple capabilities suitable for both armored vehicles and lightweight structures such as light aircraft or helicopters. The weapon should also be effective against heavily reinforced bunkers and lighter weight structures. It has not been generally suitable to use a penetrating shaped charge against a lightweight structure as the round will completely pass through, typically exploding far beyond the structure. On tests with a helicopter, for example, a penetrating round punched small entry and exit holes and thereafter exploded 40 to 50 feet beyond the target, leaving the helicopter relatively undamaged. Similarly, a non-penetrating round is also unsuited for general purpose use. For example, a non-penetrating high explosive round has little effect on a hardened vehicle or structure.

Typical solutions to the problem of differing target hardness have resulted in a variety of types of warheads in a variety of calibers. The variety of warhead types greatly increases the number of weapons required to be carried and the logistics problems associated therewith and reduces the effectiveness of any particular fireteam in the field, since the fireteam can then only deal with limited types of targets. Additionally, spotting rounds must be matched to the ballistics of a particular warhead.

The current state-of-the-art weapon comprises a rocket launcher assembly with a spotting rifle attached to the right side of the launcher tube. There are numerous deficiencies with the current design. The right-side mounted spotting rifle is difficult to load and particularly difficult to re-load as the entire assembly is located away from the gunner on the opposite side of the rocket launcher. Further, the weapon lacks good balance resulting in unwieldy handling. The sighting of the spotting rifle is time consuming and not adaptable to changes in rounds under combat conditions. Further, the operation of the spotting rifle by cocking the bolt, reloading, clearing jams and other routine operations, typically requires an assistant gunner. Finally, the weapon is heavier because of a duplication of firing mechanisms, trigger linkages, hammers, etc., and the weapon has no "clean" side so that it can be placed on the ground (the current weapon having a scope on the left side and the spotting rifle on the right side).

What is needed is a lighter weight weapon adaptable to different rounds which can be handled by a single gunner, that is, operated from only one side of the weapon, such as the left side. Additionally, dual-function mechanisms to operate both the spotting rifle and the rocket launcher are needed to reduce weight and improve reliability.

SUMMARY OF THE INVENTION

Accordingly, it is an object of the present invention to provide a shoulder-launched multi-purpose assault weapon having interchangeable rocket tubes.

It is another object of the invention to provide a shoulder-launched multi-purpose assault weapon having an adjustable spotting rifle barrel for boresighting with the rocket tube.

It is yet another object of the invention to provide a shoulder-launched multi-purpose assault weapon having dual-function assemblies for various functions including safing, firing, assembly and disassembly, bolt locking back, cartridge ejecting, and breech locking.

It is a further object of the invention to provide a shoulder-launched multi-purpose assault weapon having a single sight adjusting mechanism which simultaneously adjusts both optical and open sight systems.

It is a still further object of the invention to provide a shoulder-launched multi-purpose assault weapon having all gunner activated mechanisms including firing, reloading, clearing jams, sighting, disassembly, and safing located on a single side of the weapon, preferably the left side of the weapon, to be accessible to the gunner in a firing position.

Accordingly, the invention is a shoulder-launched multi-purpose assault weapon using a spotting rifle as the base weapon and having a rocket launcher mounted on the top side of the rifle. The rifle is configured with a single dual-function trigger mechanism which fires both the spotting rifle and the rocket launcher. A single trigger is connected to a unique dual sear mechanism operating both a rotating hammer and a plunger hammer. A single assembly and safing pin secures the trigger assembly to the weapon. When the pin is out, the weapon is safe. During assembly, the pin must be inserted and the weapon fully assembled before arming can be accomplished. A bolt lockback and cartridge ejector also serves two purposes. During firing, the device ejects spent spotting cartridges. When all cartridges have been fired, the device is used to lock the bolt open preparatory to reloading.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
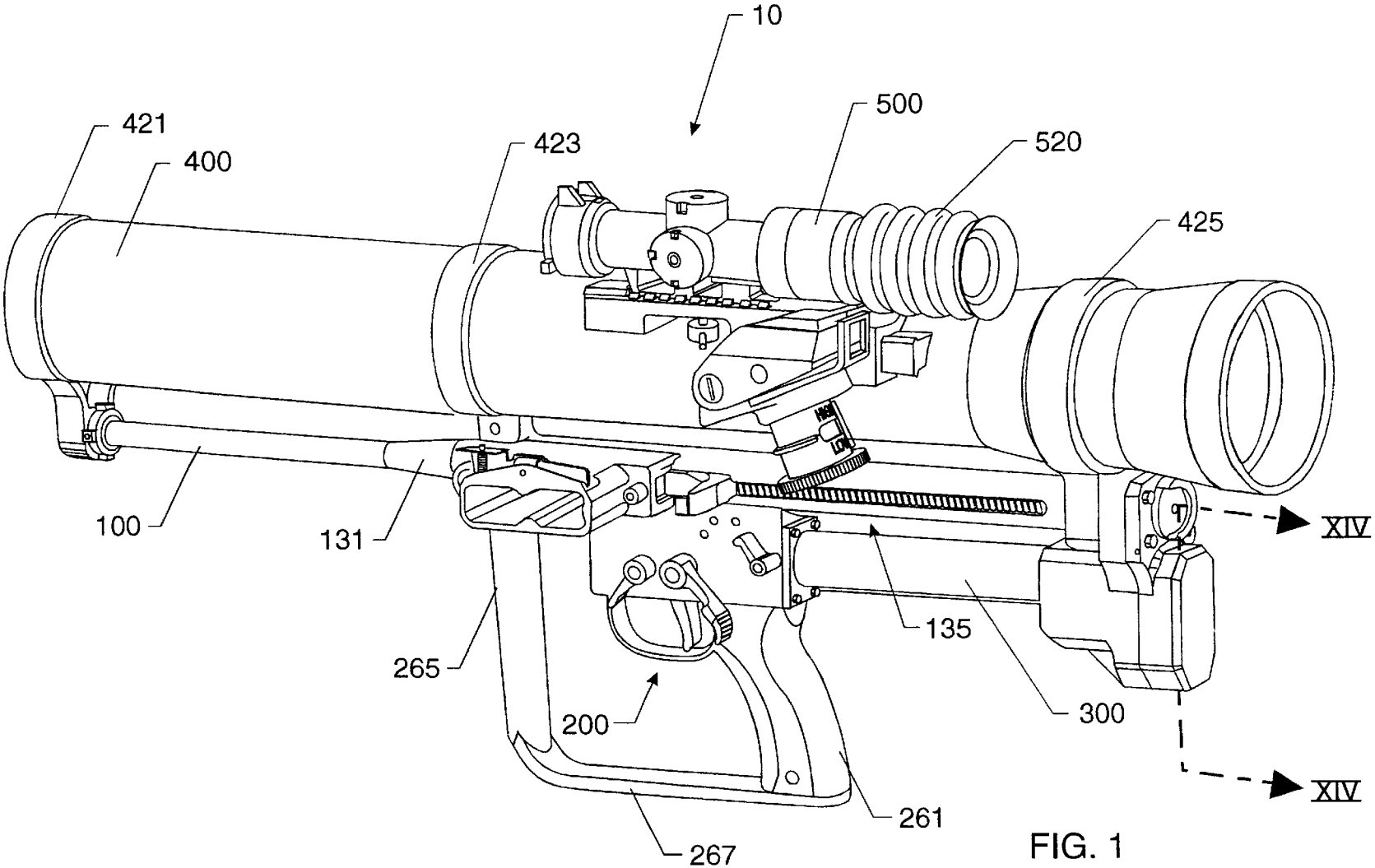
FIG. 1 is a perspective view of a shoulder-launched multipurpose assault weapon.

Referring now to FIG. 1, the overall shoulder-launched multi-purpose assault weapon, designated generally by the reference numeral 10, is shown with its major components. The weapon assembly uses spotting rifle 100 as the basic building block. Rocket launcher tube 400 is mounted atop spotting rifle 100. The sight assembly 500, comprising both an optical and open sight system, is mounted to rocket launcher tube 400. The detachable rocket launcher tube 400 is attached to spotting rifle 100 by three circular clamps, a muzzle ring bracket assembly 421, a center ring bracket assembly 423, and an aft ring bracket assembly 425. The spotting rifle itself comprises an adjustable spotting rifle barrel 131, a spring-actuated bolt assembly 135, a trigger assembly 200, and a grip bracket assembly and butt assembly 300. The grip assembly is formed by forward grip 265 and the rearward pistol grip 261 which are connected by a connecting bar 267 on the lower ends. As all components with the exception of the sight assembly 500, including the optical sight 520, are mounted on the spotting rifle, the launcher tube may be easily replaced for maintenance or for the purpose of adapting to a different diameter rocket round.

Figure 2:
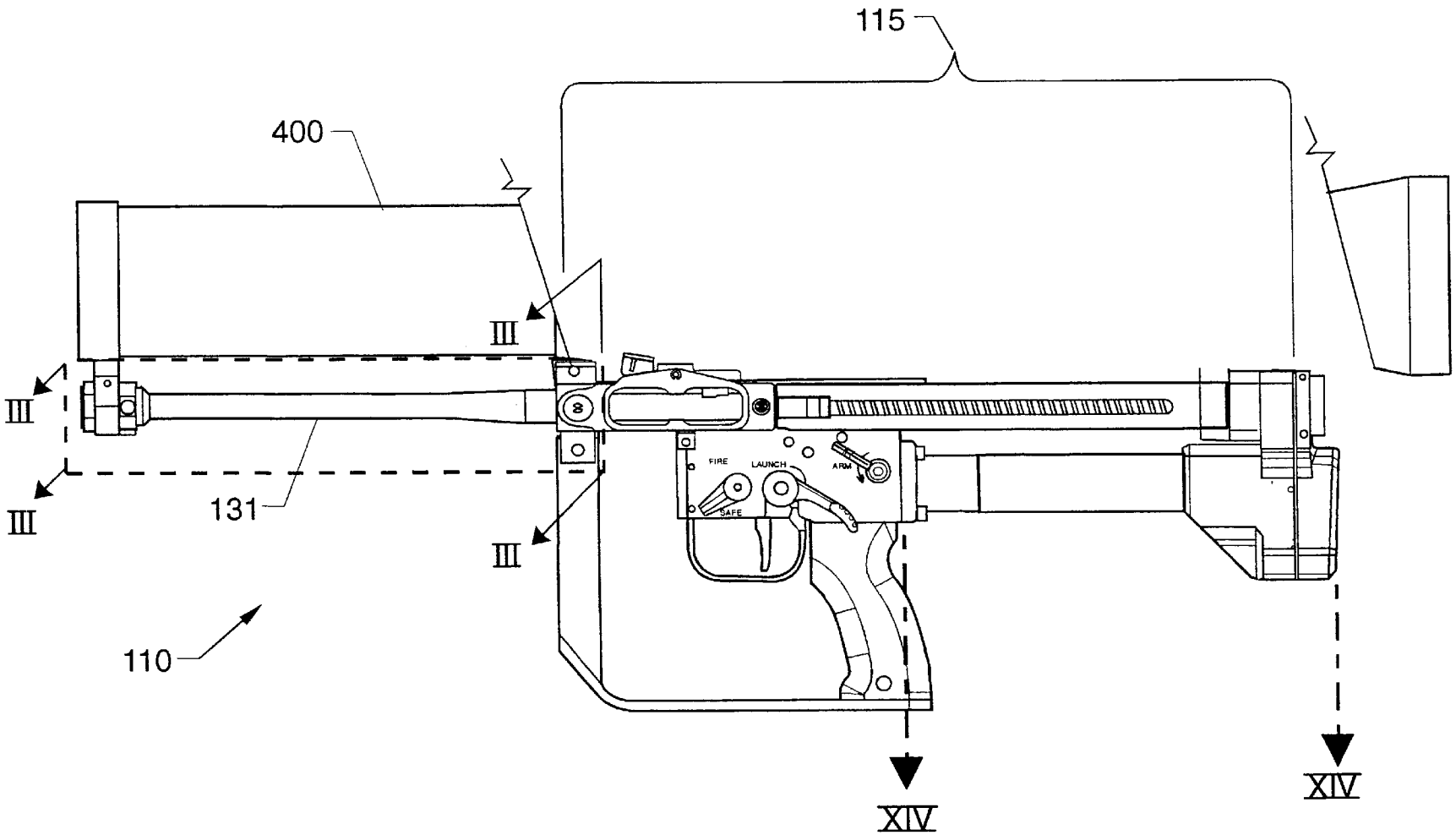
FIG. 2 is a partial side view of the weapon.

Referring now to FIG. 2, the side view of the shoulder-launched multi-purpose assault weapon is shown generally at 110. Rocket launcher tube 400 serves as a part of the mount for adjustable spotting rifle barrel 131, spotting rifle receiver assembly 115 forming the other part. The details of the spotting round rifle barrel with adjusting mechanism (as shown in dotted area III), may be seen in FIG. 3.

Figure 3:
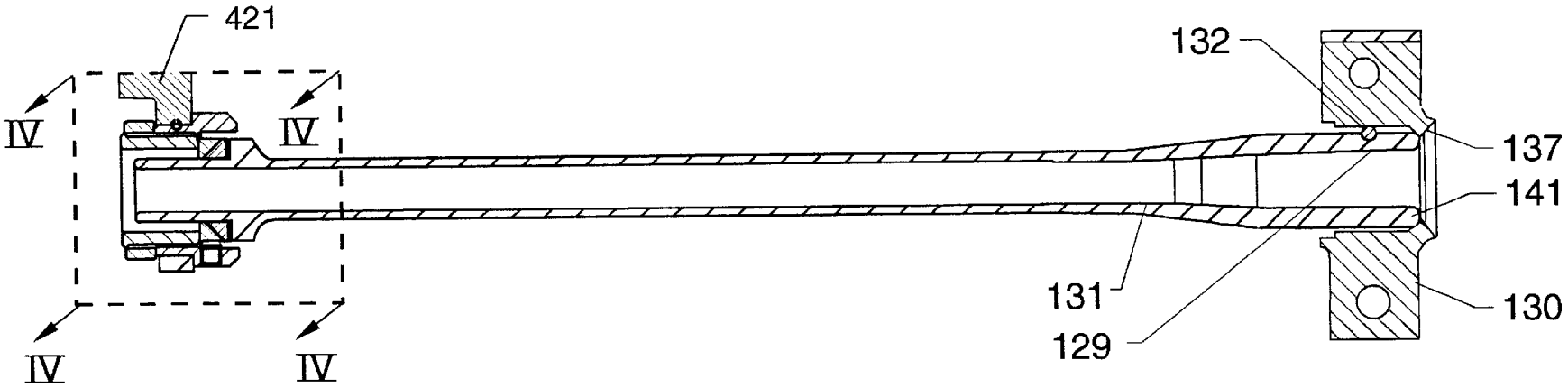
FIG. 3 is a partial cross-sectional view, taken at III in FIG. 2, showing the spotting rifle barrel.

Referring now to FIG. 3, an enlarged partial cross-sectional view taken at section III—III of FIG. 2, adjustable spotting rifle barrel 131 is shown as it is attached beneath rocket launcher tube 400. Adjustable spotting rifle barrel 131 has a retaining pin 132 to hold it attached to receiver block 130, which is attached to rocket launcher tube 400. The invention uses a convex spherical (or near spherical) surface on the rear of adjustable spotting rifle barrel 131 which is mated to a concave conical surface 137 on receiver block 130. Receiver block 130 is rigidly affixed to rocket launcher tube 400 by center ring bracket assembly 423 (as see in FIG. 1). At the muzzle end, supports for the adjustable spotting rifle barrel 131 are attached using muzzle ring bracket assembly 421. The radius of the convex spherical surface on the breech shoulders 141 of the rear of the adjustable spotting rifle barrel 131 is located at radius location 129. The radius center is located approximately a distance of one external barrel radius forward of the breech end of adjustable spotting rifle barrel 131. This radius location 129 allows a pivoting of adjusting spotting rifle barrel 131 in a small arc to maintain the rear interface of the barrel with receiver block 130. Adjustment of the angle of adjusting spotting rifle barrel 131 is accomplished by adjustment of the set screws shown more clearly in FIG. 4.

Figure 4:
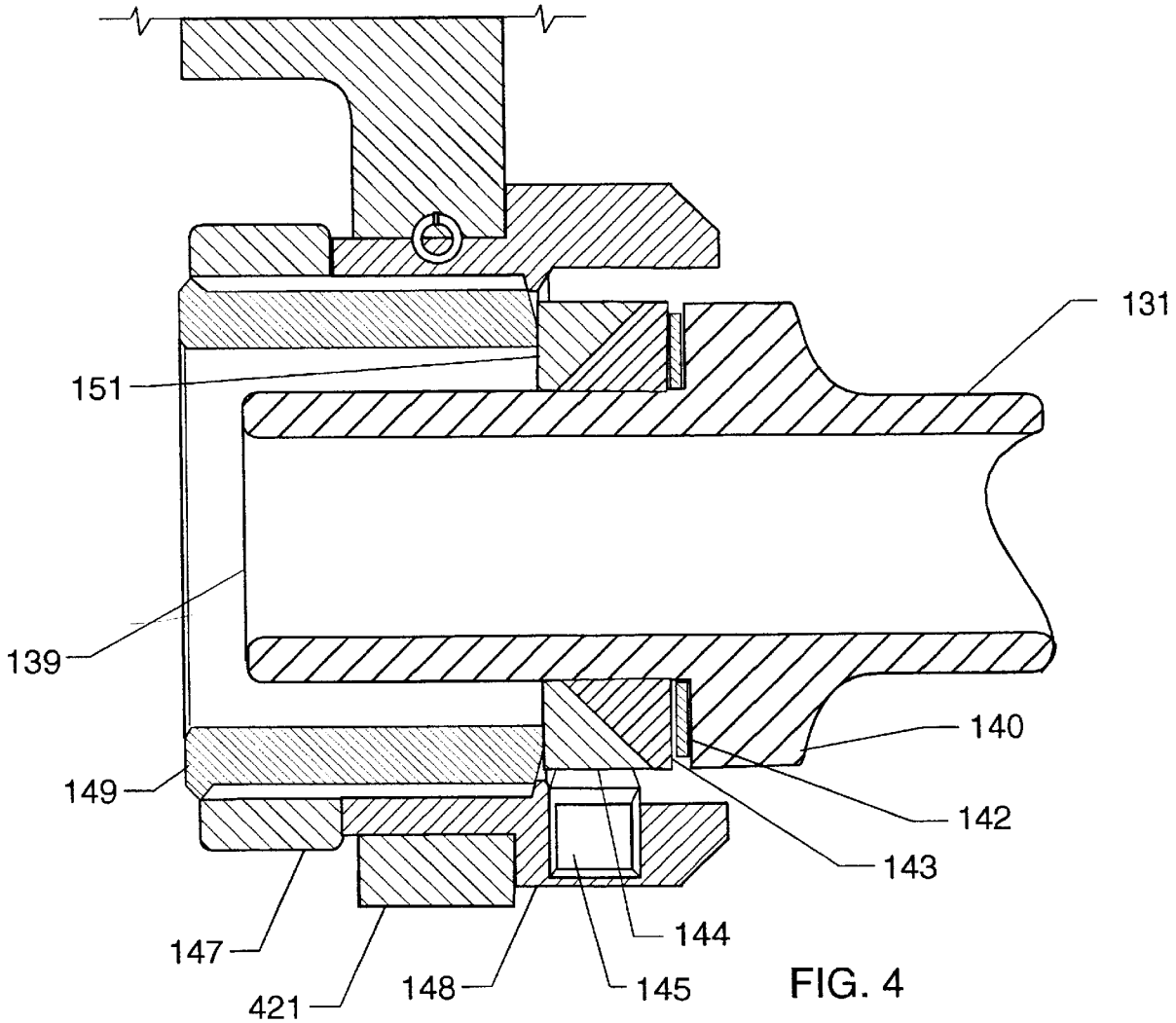
FIG. 4 is an enlarged partial cross-sectional view, taken at IV of FIG. 3, showing the spotting rifle barrel alignment components.

Referring now to FIG. 4, an enlarged partial cross-sectional view, taken at section IV-IV of FIG. 3, shows the adjustable spotting rifle barrel 131 alignment components. Immediately ahead of the muzzle shoulders 140 is a circular spring and washer assembly. This assembly includes a compression spring 142 which allows slight forward movement of the barrel. Immediately ahead of the compression spring 142 is a grip collar 143. Grip collar 143 is a split ring design allowing expansion of the collar depending on temperature of the barrel and also allowing a clamping effect as the grip collar is forced towards adjacent locating washer 144. Locating washer 144 is adjusted by three adjustment screws 145 (only one of which is shown here for clarity), each of the screws being located 120° around the barrel. The barrel locating bushing 149 is fixed around the muzzle end 139 of the adjustable spotting rifle barrel 131 and is itself encircled by bracket 421 which attaches to the main launcher tube (not shown in FIG. 4). A jam nut 147 secures the assembly to adjustable spotting rifle barrel 131. A barrel collar 148 acts as a support for locating washer 144 with respect to forward movement. Barrel collar 148 seats against locating washer 144 with a rounded surface. Locating washer 144 itself also has a spherical surface, as shown by surface 151, wherein the radius of forward side of the locating washer 144 is drawn from radius location 129, as shown in FIG. 3. As a result of both muzzle and breach radii being located around a common radius location 129, the barrel can be rotated slightly while maintaining snug contact with the fixed receiver breech surface.

The common radii centers of grip collar 143 and of the breech shoulders 141 (around radius location 129) allow the barrel to be adjusted up, down and laterally to make an exact parallel match to launcher tube barrel. As surfaces at the muzzle end and rear end of the barrel are radiused off the common center, there is no gap, extension, or spaces developed due to pivoting of the barrel. Additionally, the compression spring and conical surfaces shown on grip collar 143 and the matching conical surface on locating washer 144 allow an expansion of the barrel due to heat. As a result of these features, the spotting rifle barrel can be aligned to provide an exact parallel axis with the main longitudinal axis of the launcher tube and will remain in that position even after repeated firings and after heating of the barrel. As the barrel expands, compression spring 142 takes care of linear expansion of the barrel and the expansion of the split grip collar compensates for cross-sectional expansion of the barrel.

Figure 5A:
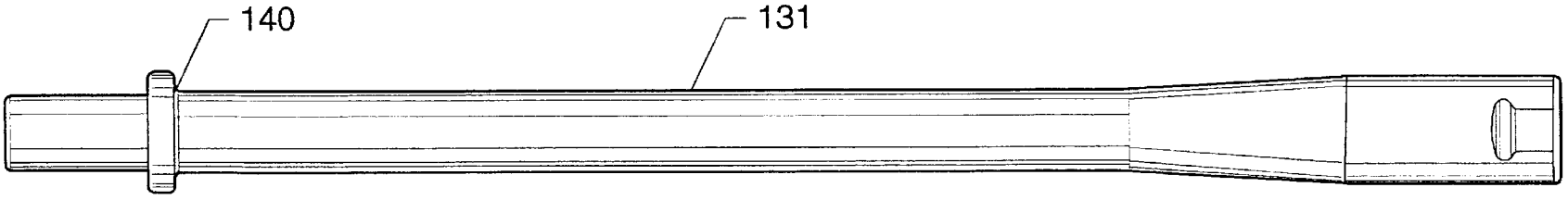
FIG. 5*a* is an isolated top view of the spotting rifle barrel.
Figure 5B:
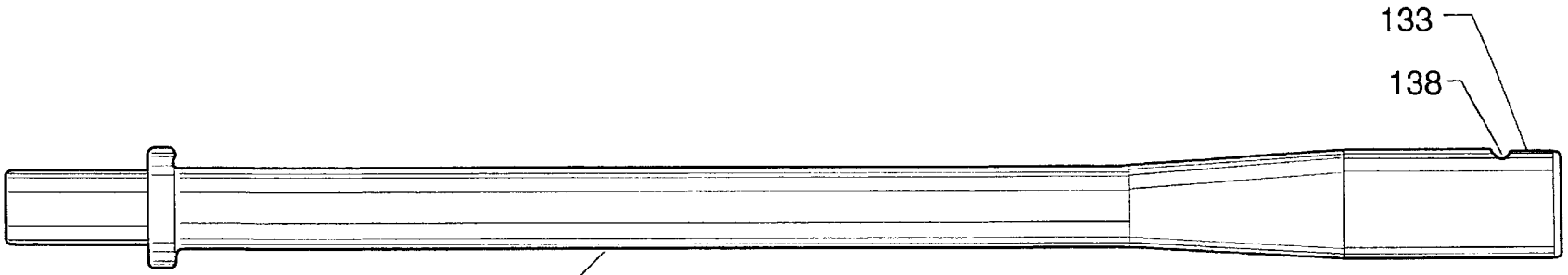
FIG. 5*b* is a view, similar to FIG. 5*a*, showing the side of the spotting rifle barrel.

FIGS. 5*a* and 5*b* show top and side views of adjustable spotting rifle barrel 131. In the top view, a machined recess for retaining pin slot 138 is shown in the machined section 133 on the breech end of adjustable spotting rifle barrel 131. Muzzle shoulder 140 is located approximately two inches aft of the muzzle. Muzzle shoulder 140 has a radiused rear face and a flat forward face. The retaining pin 132 is also located in FIG. 1 at the top of the breech end of the adjustable spotting rifle barrel 131 for reference.

Figure 6:
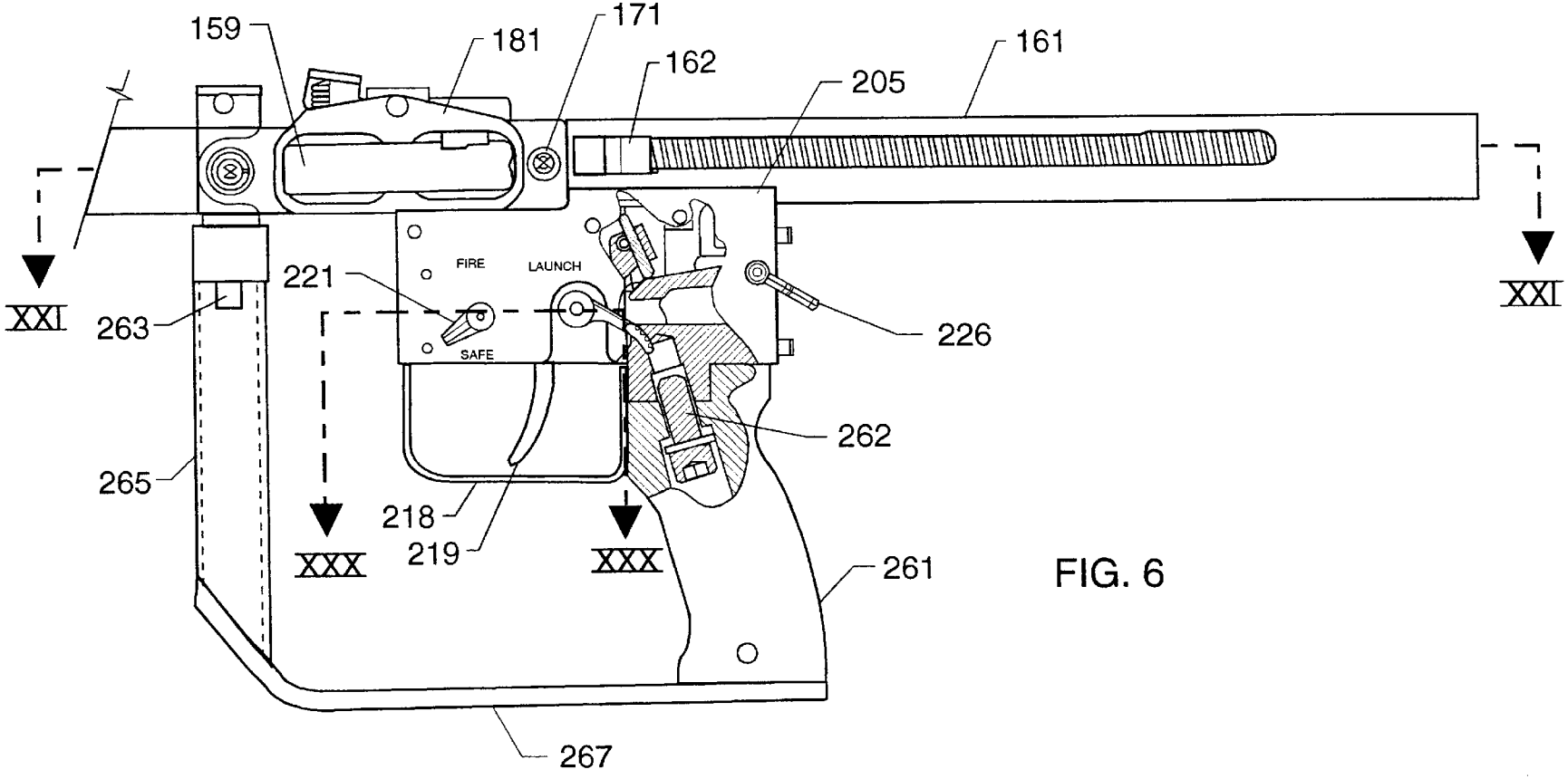
FIG. 6 is an isolated view of the side of the receiver and trigger assembly of the assault weapon.

Referring now to FIG. 6, an isolated partially cutaway top view of the side of the trigger assembly and receiver mechanism comprises a single trigger 219 operating a dual firing mechanism. The dual firing mechanism comprises a double sear and double hammer device that is illustrated in more detail in FIG. 7. The cutaway position of FIG. 6 shows the means for attaching the forward and rear portions of the stock or pistol grip 261 to trigger assembly 200. An open access bore through stock 261 provides for installing attachment screw 262 which secures stock 261 to trigger frame 211. Frame cover 205 is attached to frame 211, and combination safing and assembly pin 221. A similar screw 263, also installed from the bottom through forward grip 265, completes the installation of the grips. A flat connecting bar 267 connects pistol grip 261 and forward grip 265 making a one-piece grip assembly. Flat connecting bar 267 serves as a rest for balancing the weapon on a support or on the ground, thereby eliminating the need for a bi-pod support as used in the prior art. Thumb selector lever 226 allows selection of either spotting rifle 100 or rocket launcher tube 400 using a single trigger. Trigger guard 218 protects trigger 219. The bolt assembly 159 can be seen in the closed position inside magazine well 181. The bolt operating handle 162 and main spring receiver tube 161 are shown for reference. Located on magazine well 181 is combination bolt lockback and cartridge ejector mechanism 171. Each subassembly is further described in subsequent drawings.

Figure 7:
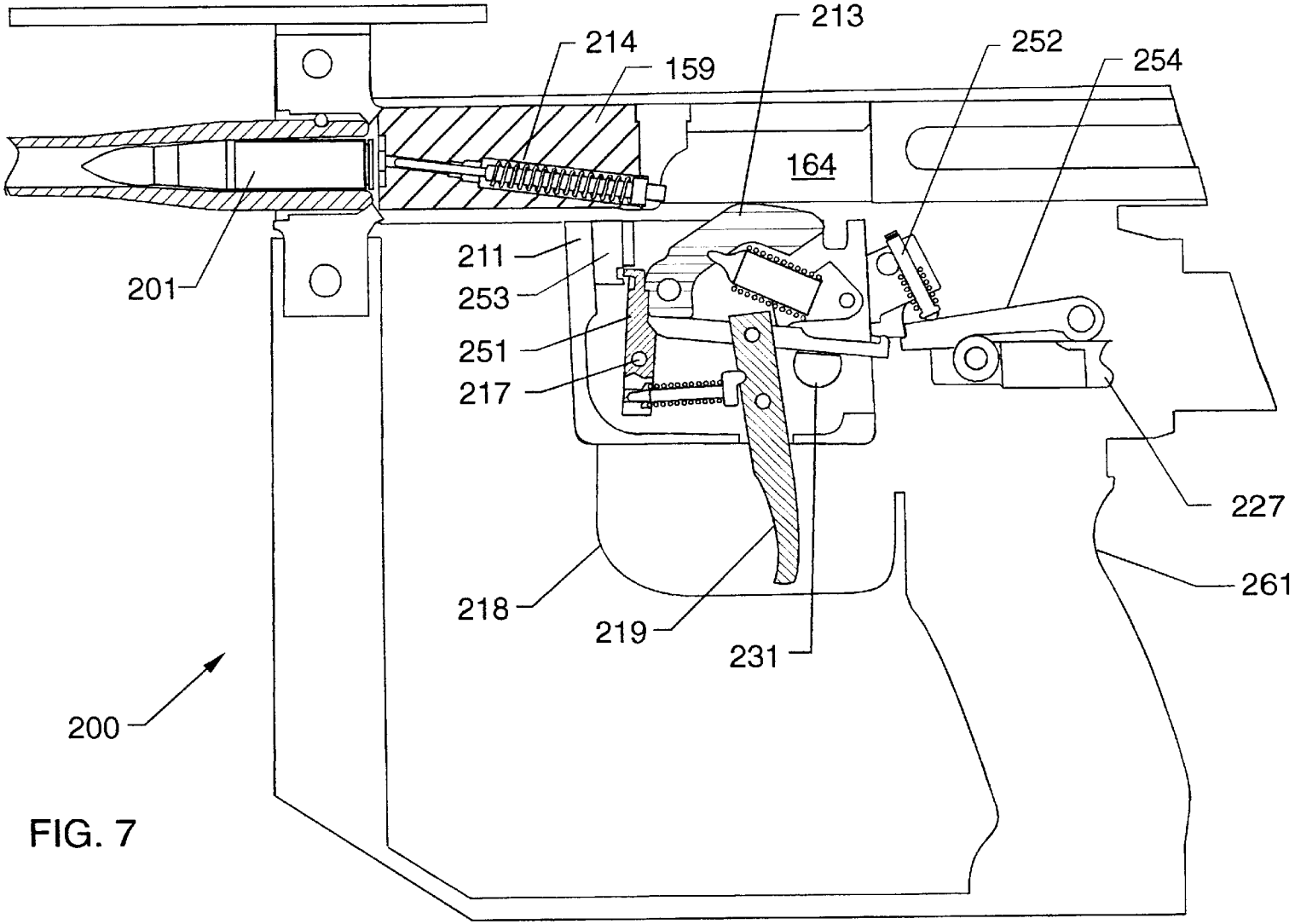
FIG. 7 is an enlarged view, similar to FIG. 6, of the trigger assembly.

Referring now to FIG. 7, operation of one of the main features of this invention may be seen in trigger assembly 200. A dual firing mechanism comprises a trigger 219 having a trigger guard 218, a connector link 217, primary and secondary sear props 253, 252, primary and secondary sears 251, 254 and primary and secondary hammers 213, 227. Dual firing mechanism is mounted inside frame 211. A thumb selector lever 226 allows the operator to select either spotting rifle or rocket firing. Primary hammer 213 is a rotating hammer which rotates into a hammer slot 164 in bolt assembly 159, thereby striking weighted cylindrical firing pin 214. Firing pin 214 has a pointed center for firing spotting rifle cartridge 201. Secondary sear 254, also operated by trigger 219, releases a plunger-style secondary hammer 227 (shown cut off in this view). Selection of the hammer to be released is made by rotating thumb selector lever 226 (shown in FIG. 6) which lever 226 is attached to cam 231. Rotating cam 231 causes trigger connector link 217 to pivot, thereby engaging either primary sear prop 253 or secondary sear prop 252. Secondary sear prop 252, secondary sear 254, and secondary hammer 227 are all housed outside trigger frame 211 over pistol grip or stock 261 of the spotting rifle. A key element of this invention is pivoting connector link 217. Connector link 217 is pivotally connected to trigger 219. Primary sear 251 prevents primary hammer 213 from rotating in a counter-clockwise direction by catching the hammer on lug 233. As trigger 219 is pulled, connector link 217 slides into contact with the lug on primary sear 251. After contact between connector link 217 and primary sear 251 is made at lug 233, further application of pressure to trigger 219 will cause L sear 251 to move counterclockwise out of contact with primary hammer 213 allowing operation of the hammer.

Figure 8:
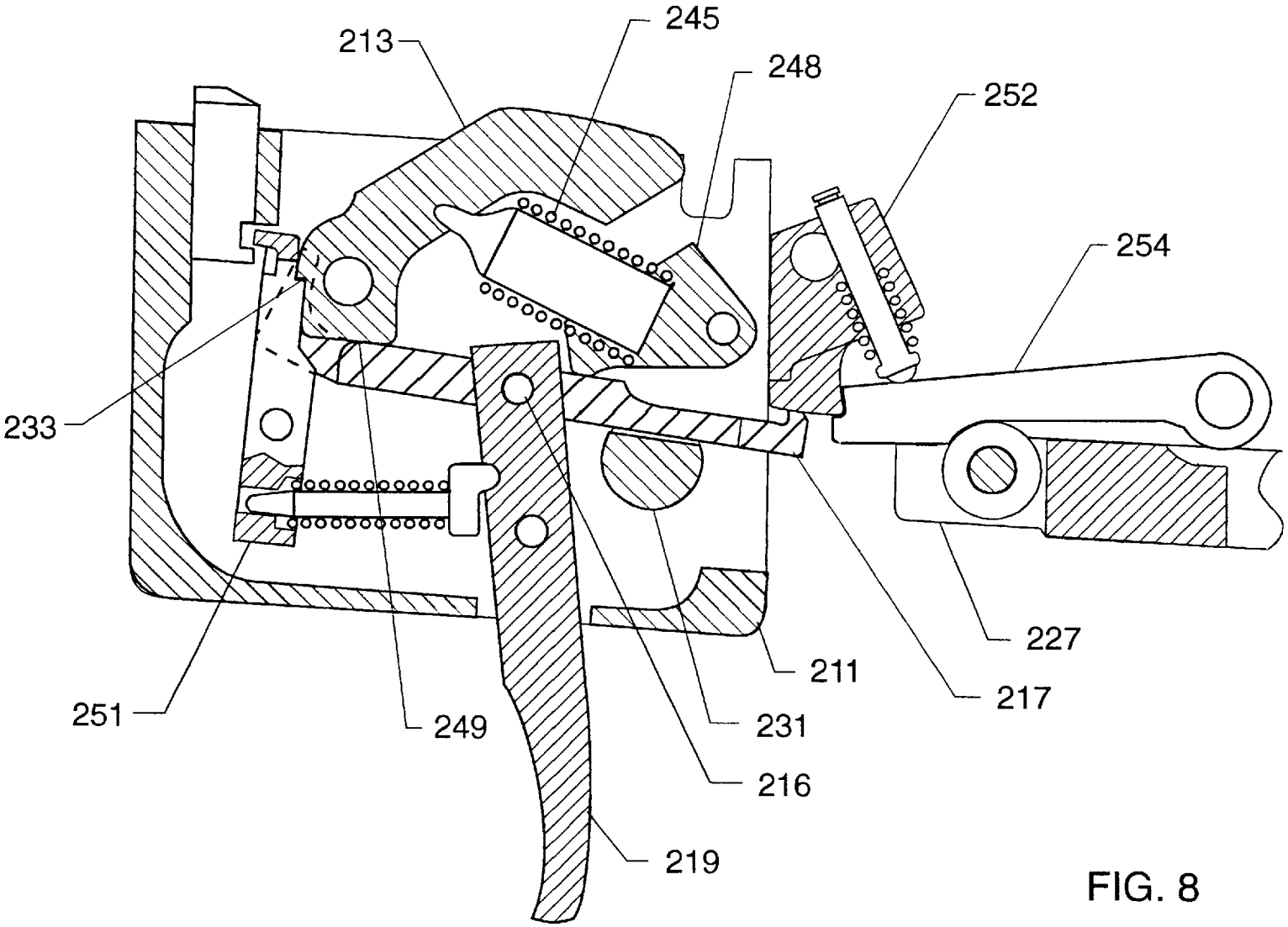
FIG. 8 shows a schematic view of the dual firing mechanism with the primary sear engaging the connector link.

Operation of the trigger and dual firing mechanism may be more fully understood by reference to FIGS. 8–13. Referring now to FIG. 8, an enlarged isolated view of the dual firing mechanism is shown as mounted inside frame 211. Rotating the eccentric cam 231 (by thumb-operated selector lever 226 shown in FIG. 6), adjusts connector link 217 for engagement of either primary sear 251 or secondary sear 254. Secondary sear prop 252, secondary sear 254, and secondary hammer 227 are all housed outside frame 211 over stock 261 (shown in FIG. 7). As trigger 219 is pulled, connector link 217 (pivotably connected to trigger 219 by horizontal pin 216) slides into contact with a lug 233 on primary sear 251. Connector link 217 is forced into contact with the lower surface of primary hammer 213 at point 249 by the action of connector link spring lever 248. Spring lever 248 is forced to rotate in a counterclockwise direction by is primary hammer spring 245. After contact between connector link 217 and primary sear 251 is made at lug 233 further application of pressure to trigger 219 will cause sear 251 to move counterclockwise out of contact with primary hammer 213, allowing operation of hammer 213. As depicted, primary hammer 213 is a rotating type hammer of conventional design.

Figure 9:
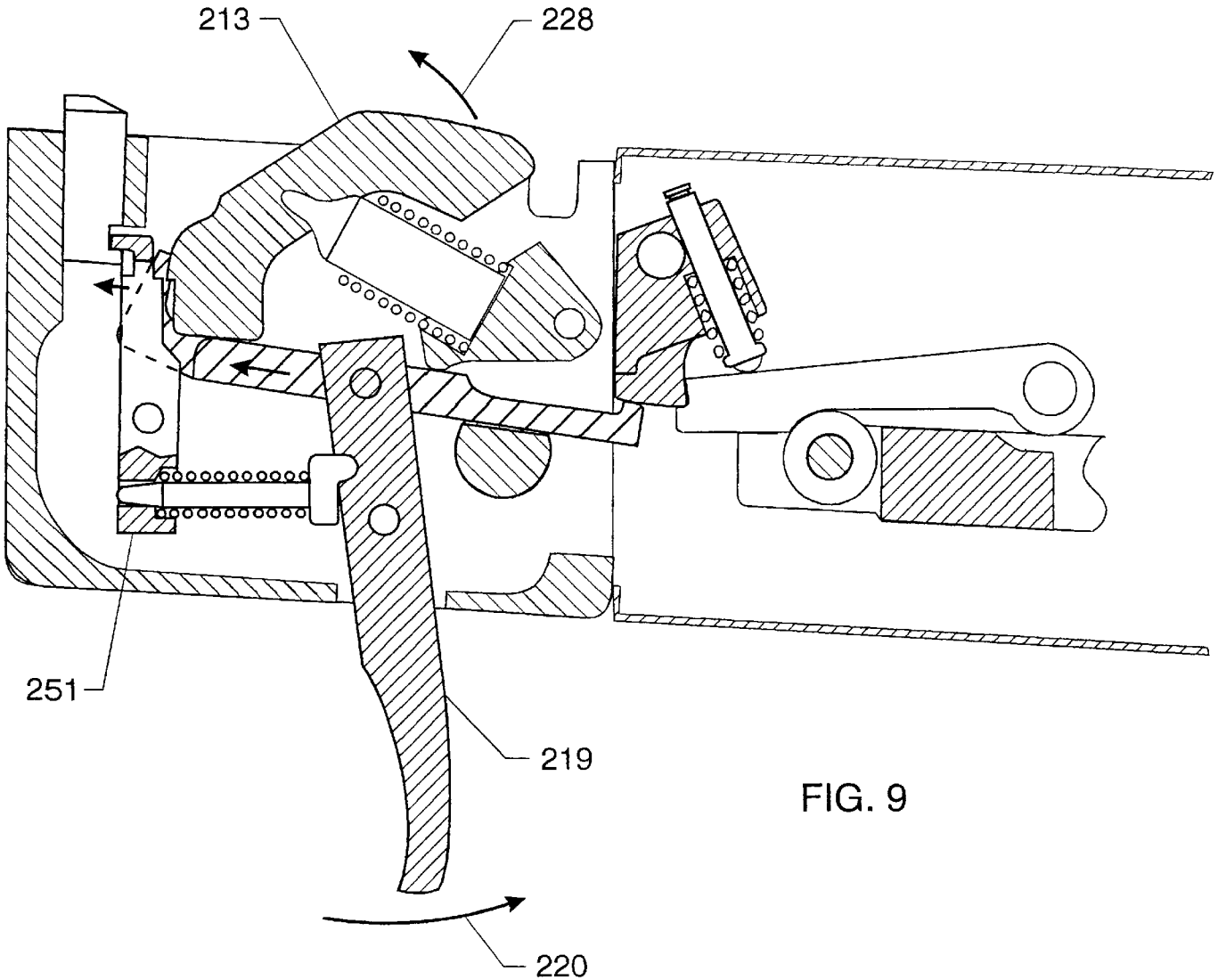
FIG. 9 is a schematic view showing operation of the primary hammer with arrows depicting potential movement of the components.

Referring now to FIG. 9, a schematic view showing operation of the primary hammer with arrows depicting potential movement of the components can be seen. As trigger 219 is depressed, as depicted by arrow 220, sear 251 moves out of contact with primary hammer 213 which begins to rotate in a counterclockwise direction as shown by arrow 228.

Figure 10:
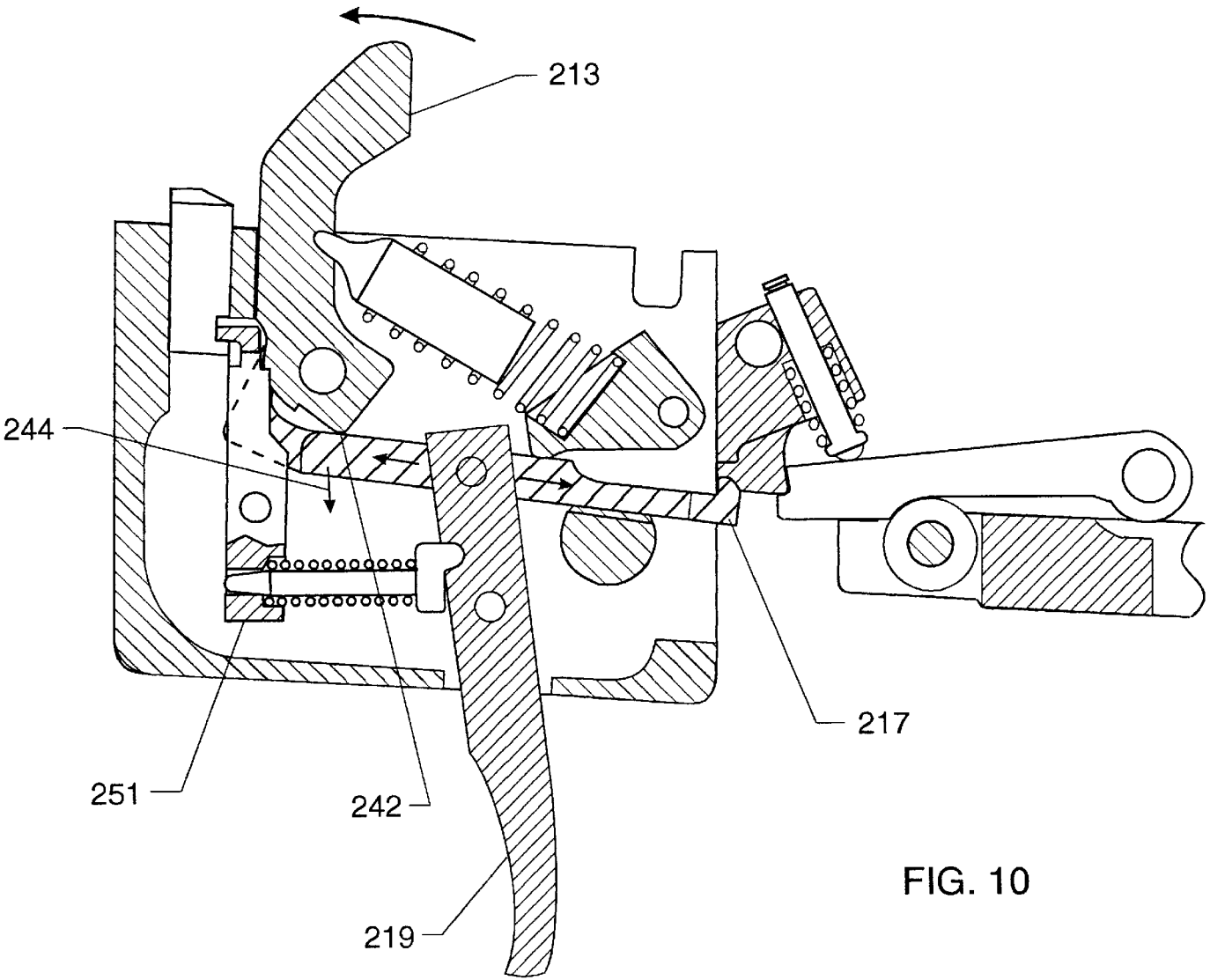
FIG. 10 shows the primary hammer in the fully extended position with arrows depicting potential movement of the components.

Further operation of the primary hammer may be seen by referring to FIG. 10. In this figure, after the complete travel is of trigger 219, primary hammer 213 is in a fully extended position. The disconnecting action of pivoting connector link 217 is shown in this view where tip 242 of primary hammer 213 has caused pivoting connector link 217 to move in a downward direction as shown by arrow 244. In this positions connector link 217 is no longer in contact with primary sear 251. Sear 251 cannot rotate clockwise under the pressure of its spring (to re-engage the notch on the primary hammer) until the hammer is recocked. In order for the connector to come in contact with the sear, force must be removed from trigger 219. Releasing trigger 219 allows connector link 217 to move rearward and reengage the sear.

Figure 11:
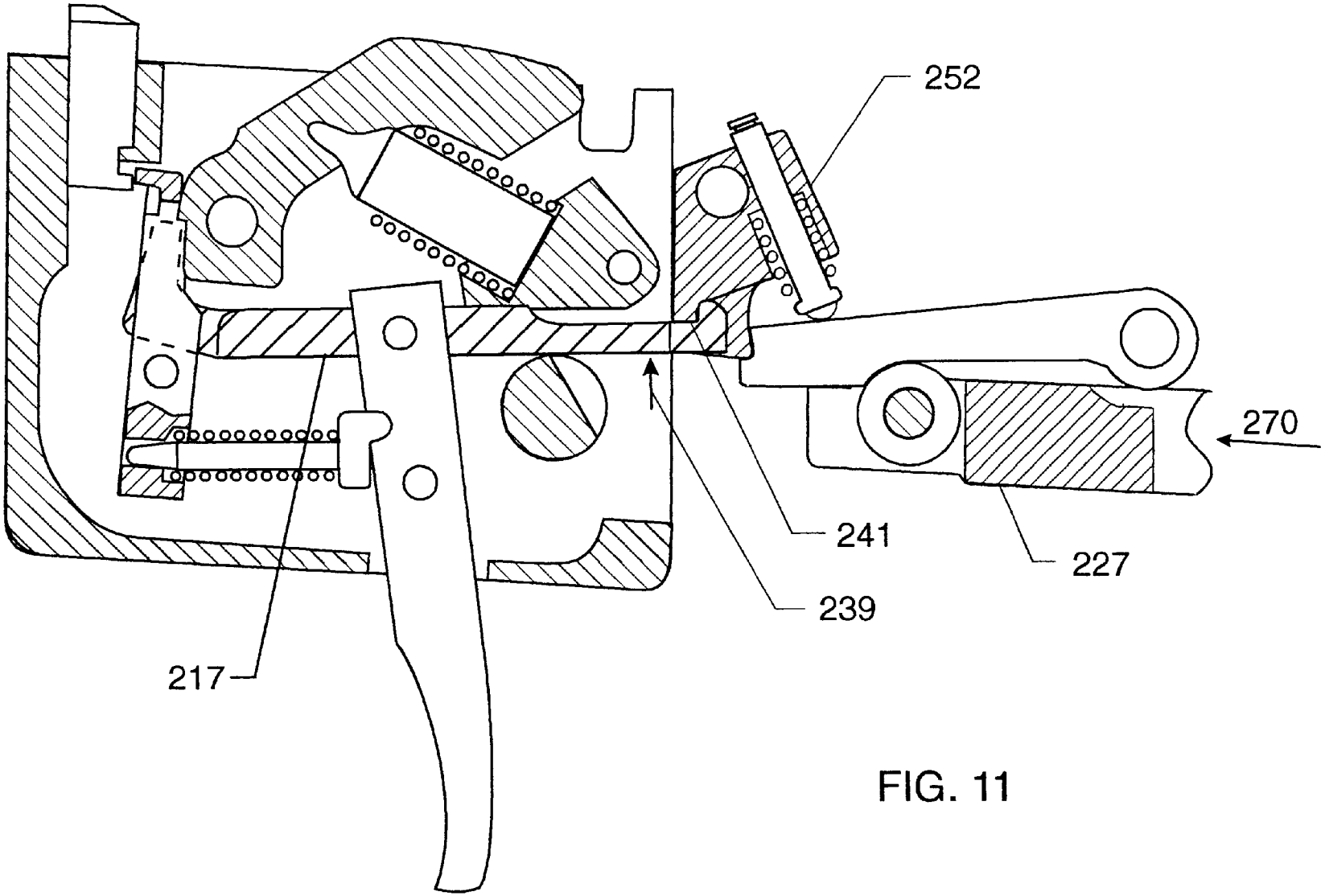
FIG. 11 shows the connector link engaging the secondary sear assembly.

Referring now to FIG. 11, a schematic view, similar to FIG. 10, of the connector link engaging the secondary sear assembly is shown. Operation of secondary sear and secondary hammer can be seen where connector link 217 is rotated, as shown in a clockwise direction. Connector link 217 is forced to rotate in a counterclockwise direction as shown by arrow 239. This rotation causes an engagement with secondary sear prop 252 at lug position 241. A spring force, represented by arrow 270, is applied to secondary hammer 227. Secondary hammer 227 is a plunger or piston style hammer which operates by sliding right to left in this depiction.

Figure 12:
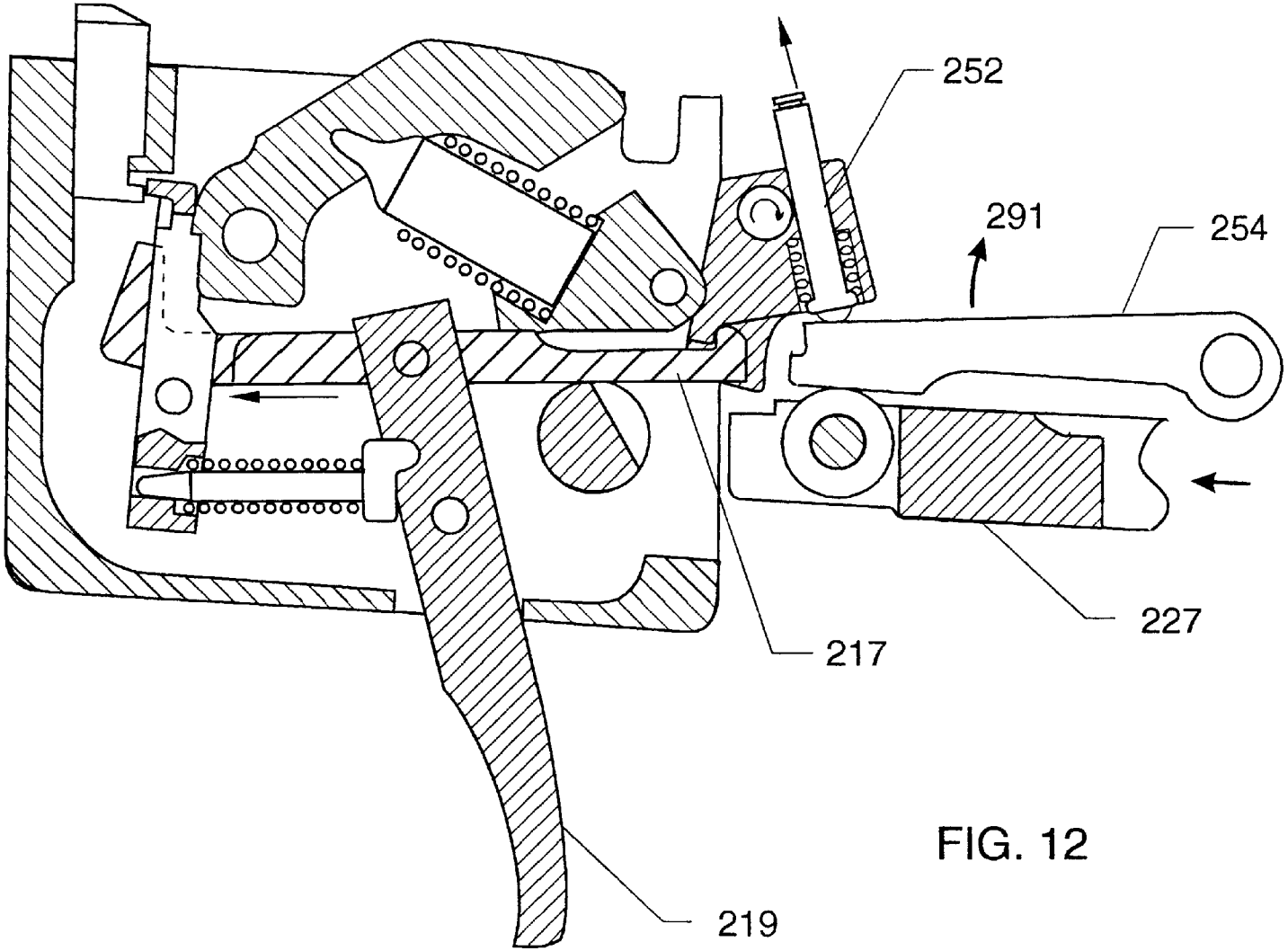
FIG. 12 shows the secondary sear tripped.

Referring now to FIG. 12, a schematic view, similar to FIG. 11, of the secondary sear tripped is shown with trigger 219 fully depressed, secondary sear prop 252 is pulled by connector link 217 out of contact with secondary sear 254, thereby allowing secondary hammer 227 to force secondary sear 254 to rotate clockwise (depicted by rotation arrow 291) as it moves to the left.

Figure 13:
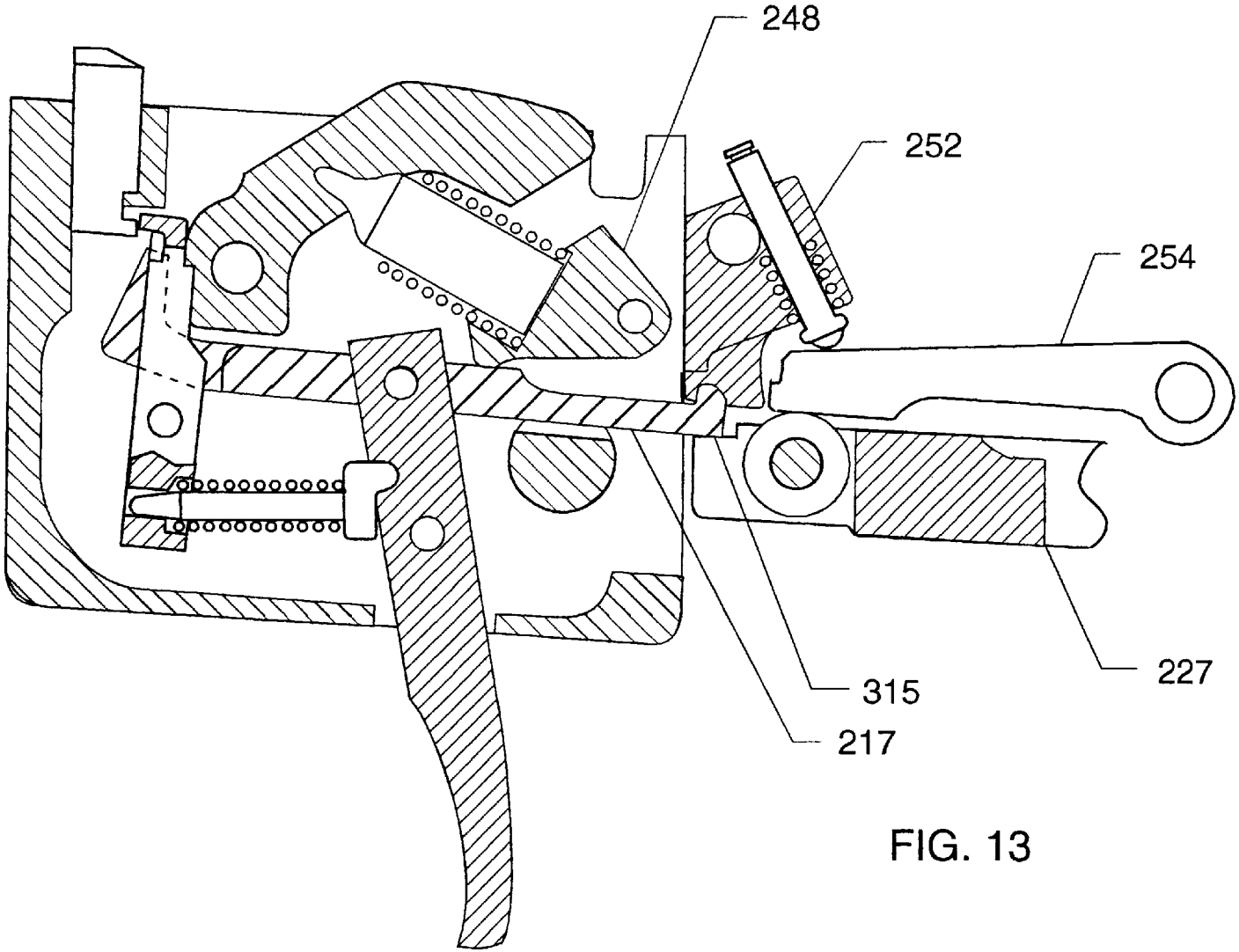
FIG. 13 shows the secondary hammer fully extended and preventing connector link engagement.

Referring now to FIG. 13, a schematic view, similar to FIG. 12 of the secondary hammer 227 is shown at the extent of its movement. Hammer nose 315 lies in a position to prevent connector link 217 from rotating clockwise under force from connector link spring lever 248. In this position, connector link 217 cannot engage either sear mechanism. Further, firing of the spotting rifle after firing the main round is prevented by this sear location. The secondary sear prop 252 and secondary sear 254 are shown for reference.

Figure 14:
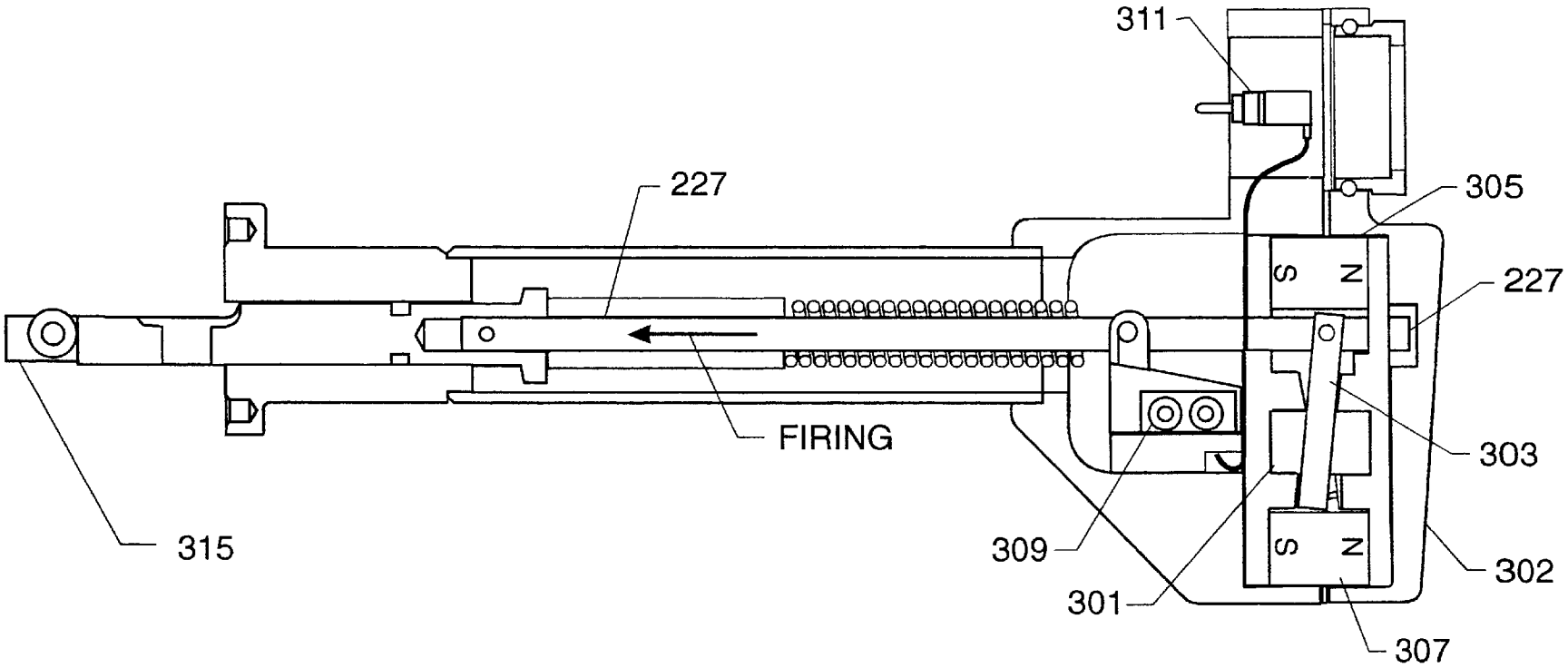
FIG. 14 is an isolated side view of the internal mechanism of the butt assembly.

FIG. 14, an isolated side view as taken along lines XIV—XIV of FIG. 2, shows the internal mechanism of butt assembly 300 (shown in FIG. 1). Butt-assembly 300 contains secondary hammer 227 extending to the rear of the assembly. A single pulse high voltage generator 301, contained within sealed butt casing 302, provides the electrical pulse to fire a rocket round. During operation, pulse generator 301 is actuated by plunger-style secondary hammer 227, which causes magneto bar 303 to snap across poles of magnets 305 and 307, thereby reversing the polarity and generating a pulse firing charge. Conventional circuitry 309 routes the charge through a pair of connectors 311 (only one shown in FIG. 14) to the rocket in the launcher tube. The entire unit is sealed in butt assembly 300 so that it is both waterproof and dirt and dust proof. The hammer nose 315 is shown for reference with the preceding drawing.

Figure 15:
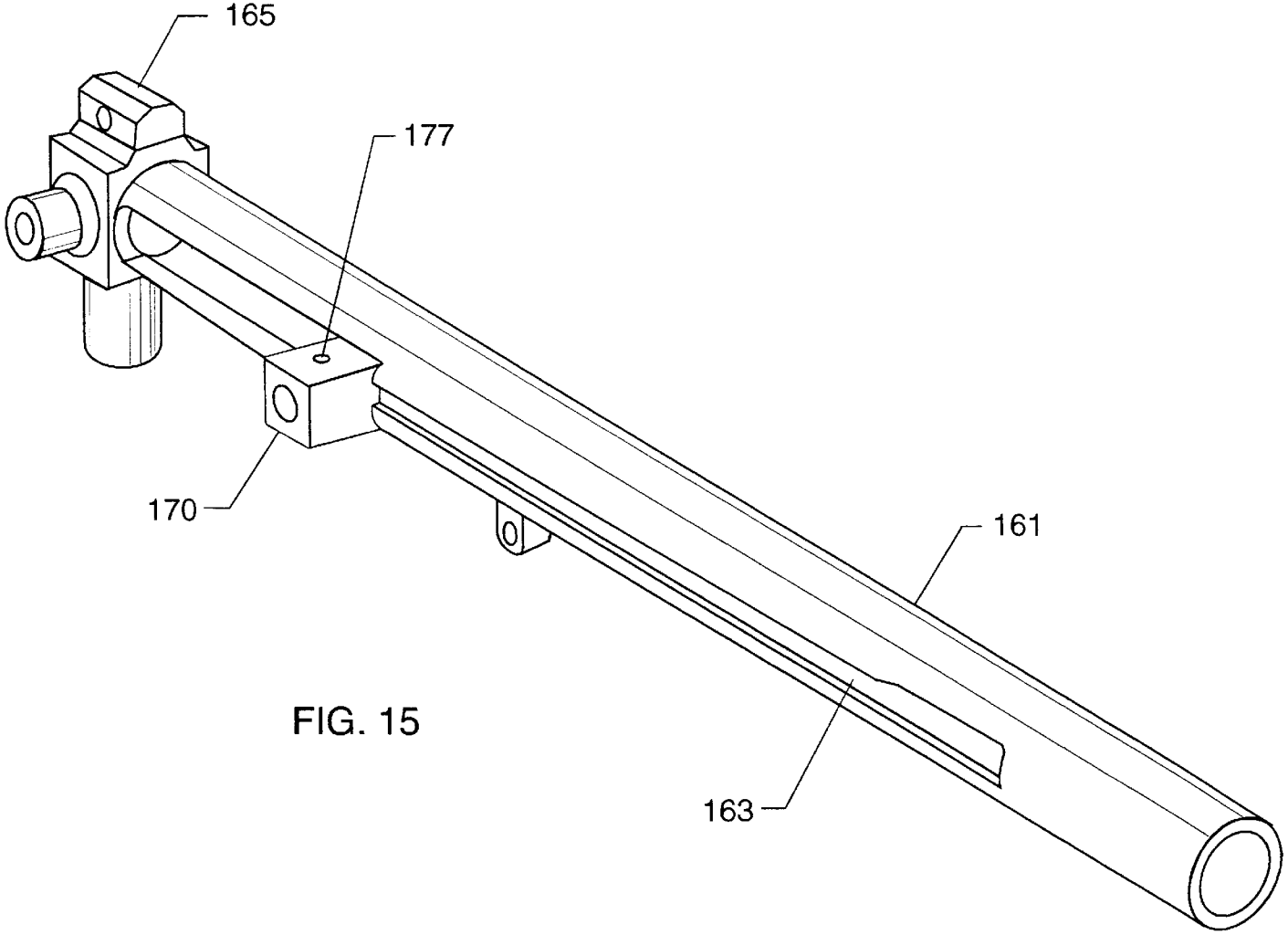
FIG. 15 is an isolated perspective view of the main spring receiver.

FIG. 15 is an isolated perspective view of main spring receiver tube 161 with bolt operating slot 163 identified. Mounting block 170 holds combination bolt lockback and cartridge ejector mechanism 171 (shown in FIG. 6 and more fully described in FIGS. 19–24) using a pin (not shown in FIG. 15) through bore 177. Mounting lug 165 mates with center ring bracket assembly 423 (shown in FIG. 1).

Figure 16:
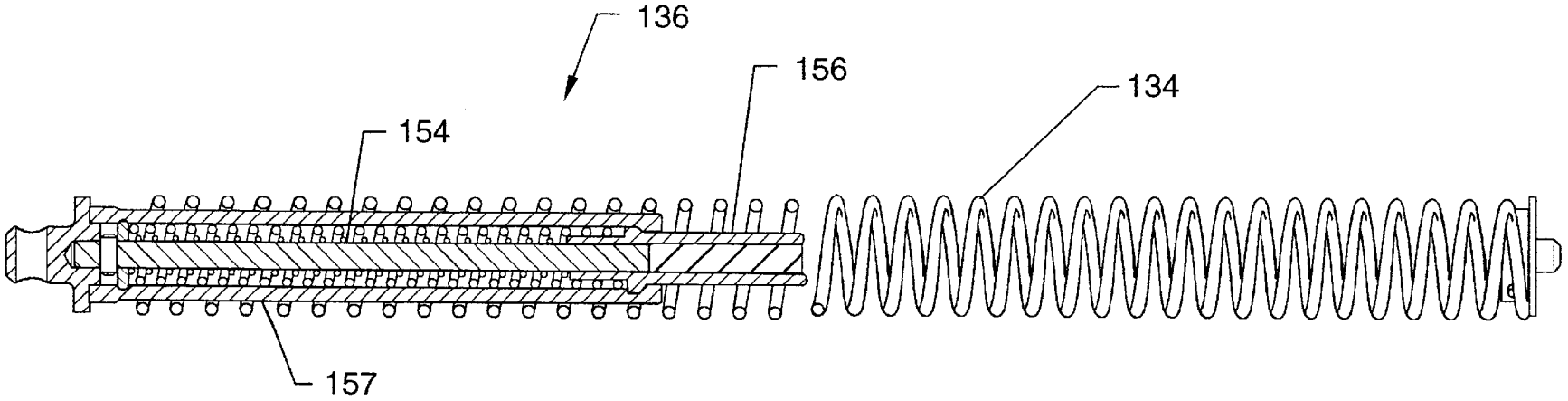
FIG. 16 is a side view with a partial cutaway of the main spring assembly.

FIG. 16 is an isolated side view of main spring assembly 136. Main spring assembly 136 comprises a main spring 134 and an inner spring 154 (shown in partial cross-section). Concentric inner section 156 and concentric outer section 157 allow bolt assembly 159 (not shown in FIG. 16) to provide a dynamic response when the weapon is fired so that the spent cartridge is ejected and a new round is chambered.

Figure 17:
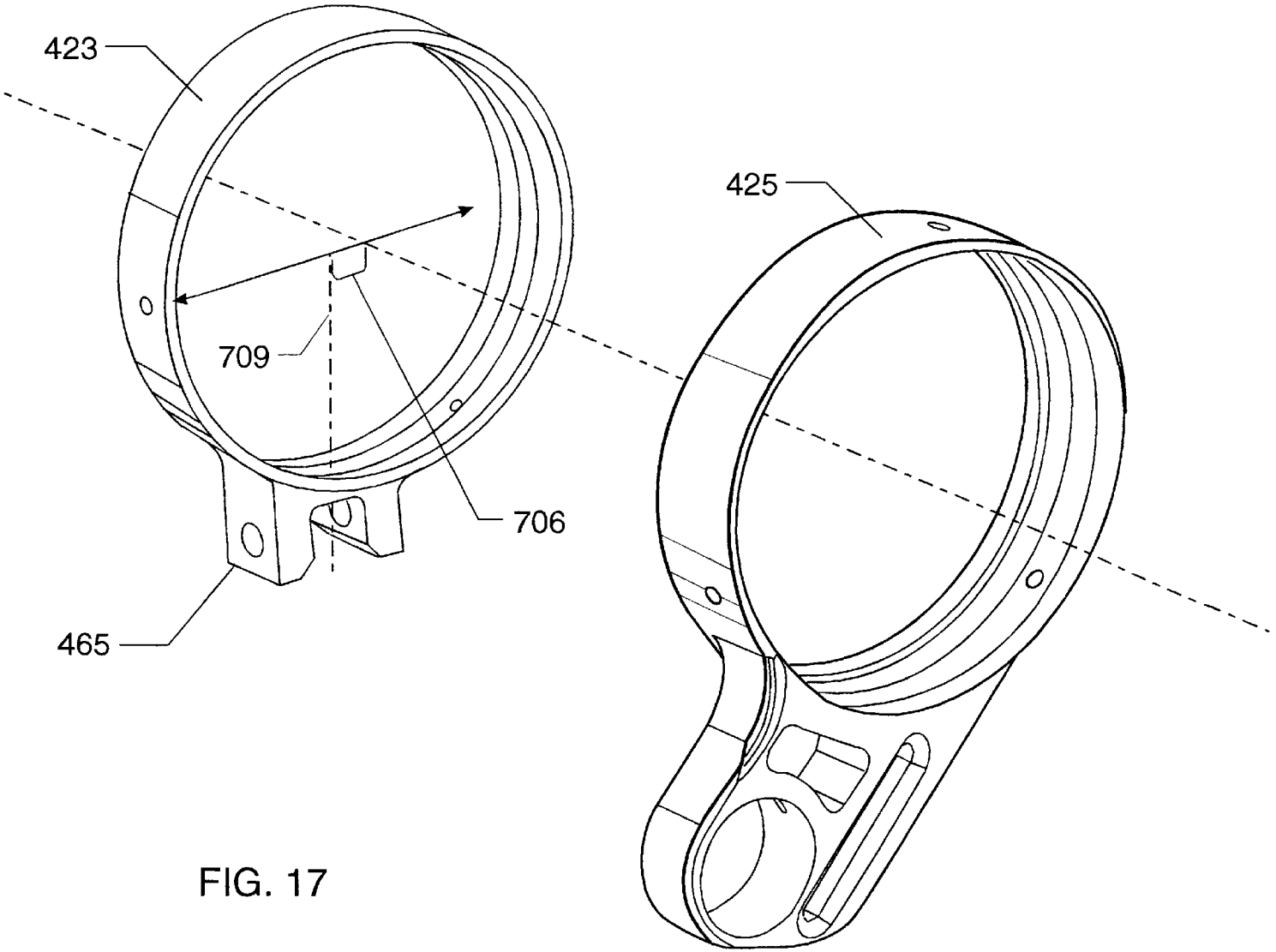
FIG. 17 is a perspective view of the forward and center clamp rings.

Referring now to FIG. 17, a perspective view of the forward and center clamp rings, bracket 465 mates on center ring bracket assembly 423 with mounting lug 165 (shown in FIG. 15) to attach rocket launcher tube 400 (not shown in FIG. 17) to spotting rifle trigger and receiver group. Aft ring bracket assembly 425 is shown for reference. As shown by offset 706, the position of rocket launcher tube 400 is mounted off-center and to the right of the centerline 709 of the spotting rifle. This offset provides a proper lateral balance to the weapon and locates optical sight 520 (shown in FIG. 1) in a more nearly aligned position with the gunner's sight line.

Figure 18B:
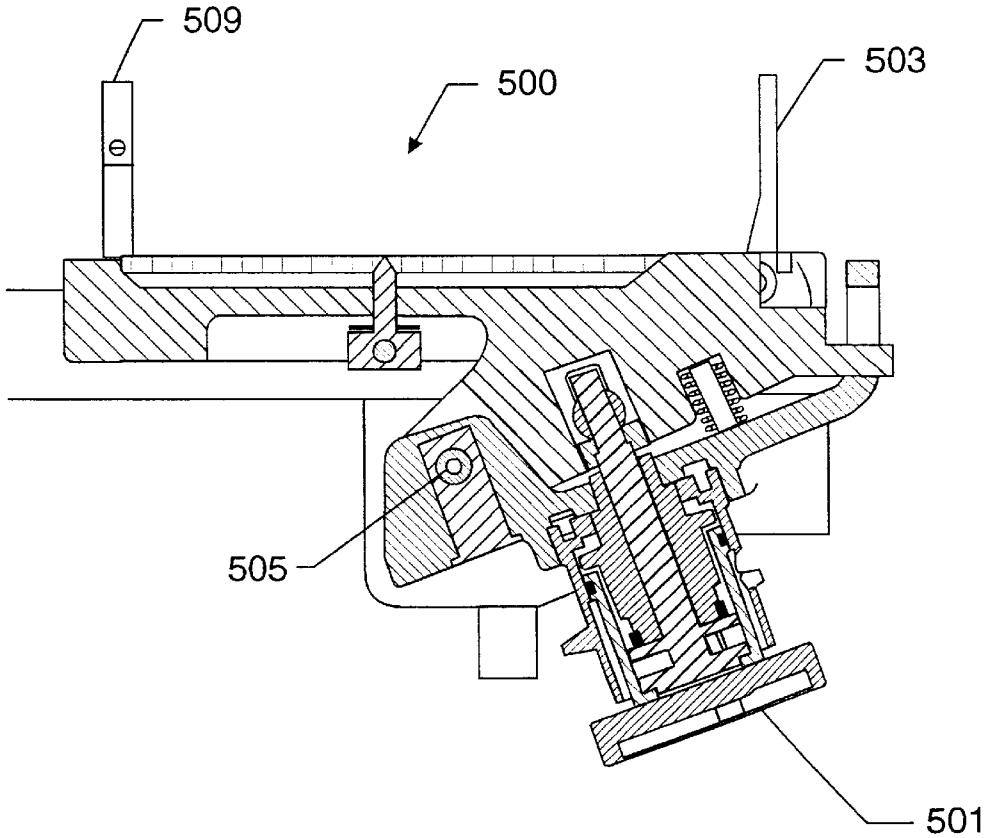
FIG. 18*b* is a cross-section of the open sight and mount assembly.
Figure 18A:
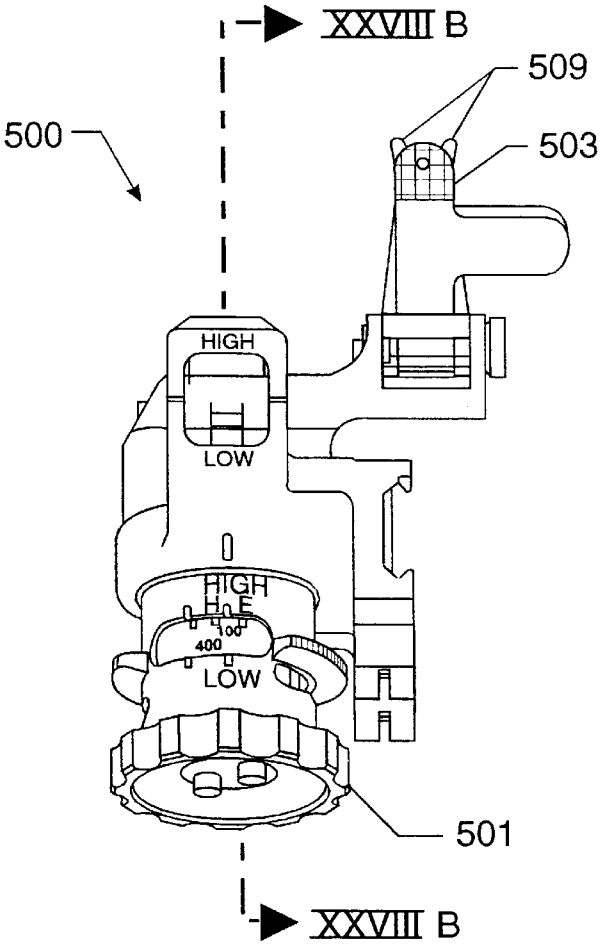
FIG. 18*a* is a rear view of the open sight and mount assembly.

The remaining major component of the weapon is combination optical and open sight assembly 500. The components of the sight assembly (with optical sight 520 removed for clarity) are shown in FIGS. 18*a* and b. FIG. 18*a* is a rearview, as seen by the operator, showing elevation adjustment knob 501 and rear peep sight 503. FIG. 18*b* is a cross-section, as taken along lines XVIIB—XVIIB of FIG. 18*a*, showing elevation pivot 505 and elevation knob 501 with its operating mechanism. Front sight 509 is a V-shaped sight as may be partially seen in FIG. 18*a*. Sight adjustments move both the optical tube (not shown in FIGS. 18*a* and 18*b*) and open sights formed by rear peep sight 503 and front sight 509. By this arrangement, both sets of sights (the open sights and the optical sights) are adjusted simultaneously, thereby allowing an immediate transition between the optical sight and the open sight as needed.

Figure 19:
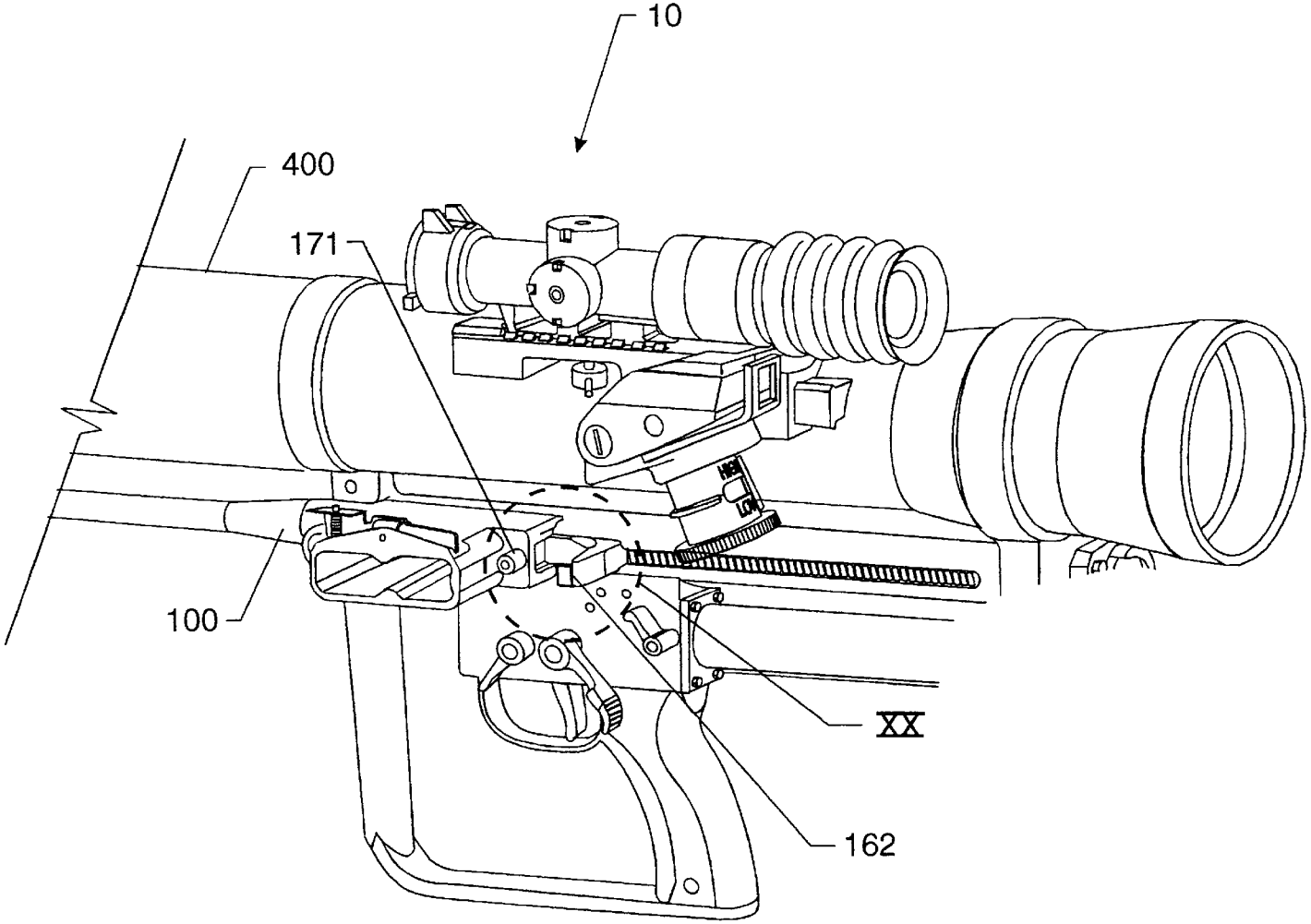
FIG. 19 is a perspective partial view of the multiple-purpose assault weapon showing the combination bolt lock and cartridge ejector mechanism.

Referring now to FIG. 19, combination bolt lockback and cartridge ejector mechanism 171 mounted on the receiver of spotting rifle 100 which is attached to a rocket launcher tube 400. The entire weapon is referenced generally by numeral 10. Within dotted circle XX, bolt operating handle 162 is shown for reference.

Figure 20:
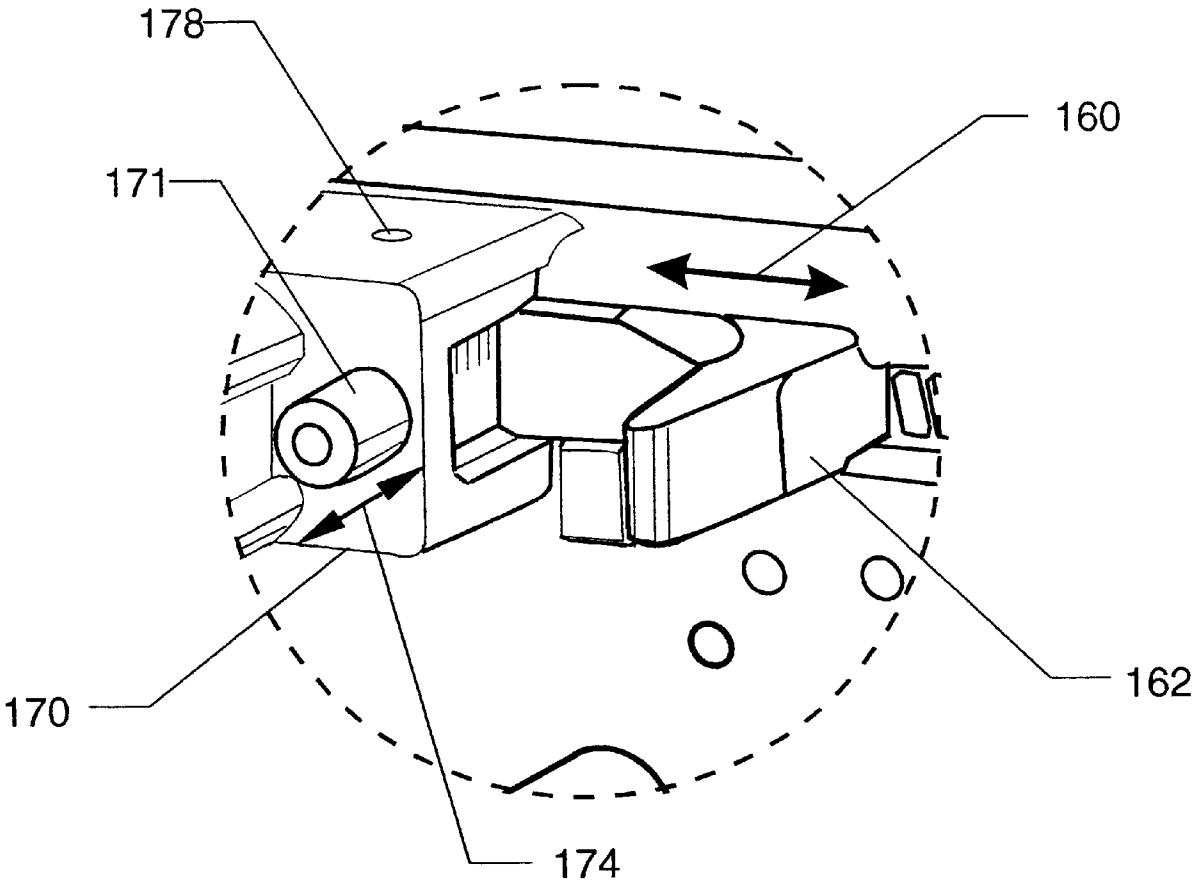
FIG. 20 is an enlarged view of the area of the combination bolt and cartridge ejector designated in dotted area XX in FIG. 19.

The details of combination bolt lockback and cartridge ejector mechanism 171 may be seen in FIG. 20 which is an enlargement of dotted area XX of FIG. 19. The bolt (not visible in this view but attached to bolt handle 162) operates in left and right directions as depicted by arrow 160. Combination bolt lockback and cartridge ejector mechanism 171 moves in and out of mounting block 170 as depicted by arrow 174. When the bolt assembly is drawn back to a rearward position (to the right in the Figure), combination bolt lockback and cartridge ejector mechanism 171 can be depressed by the operator to slide in front of bolt assembly as depicted by arrow 174, thereby locking the assembly open. The entire mechanism is held in place by pin 178.

Figure 21:
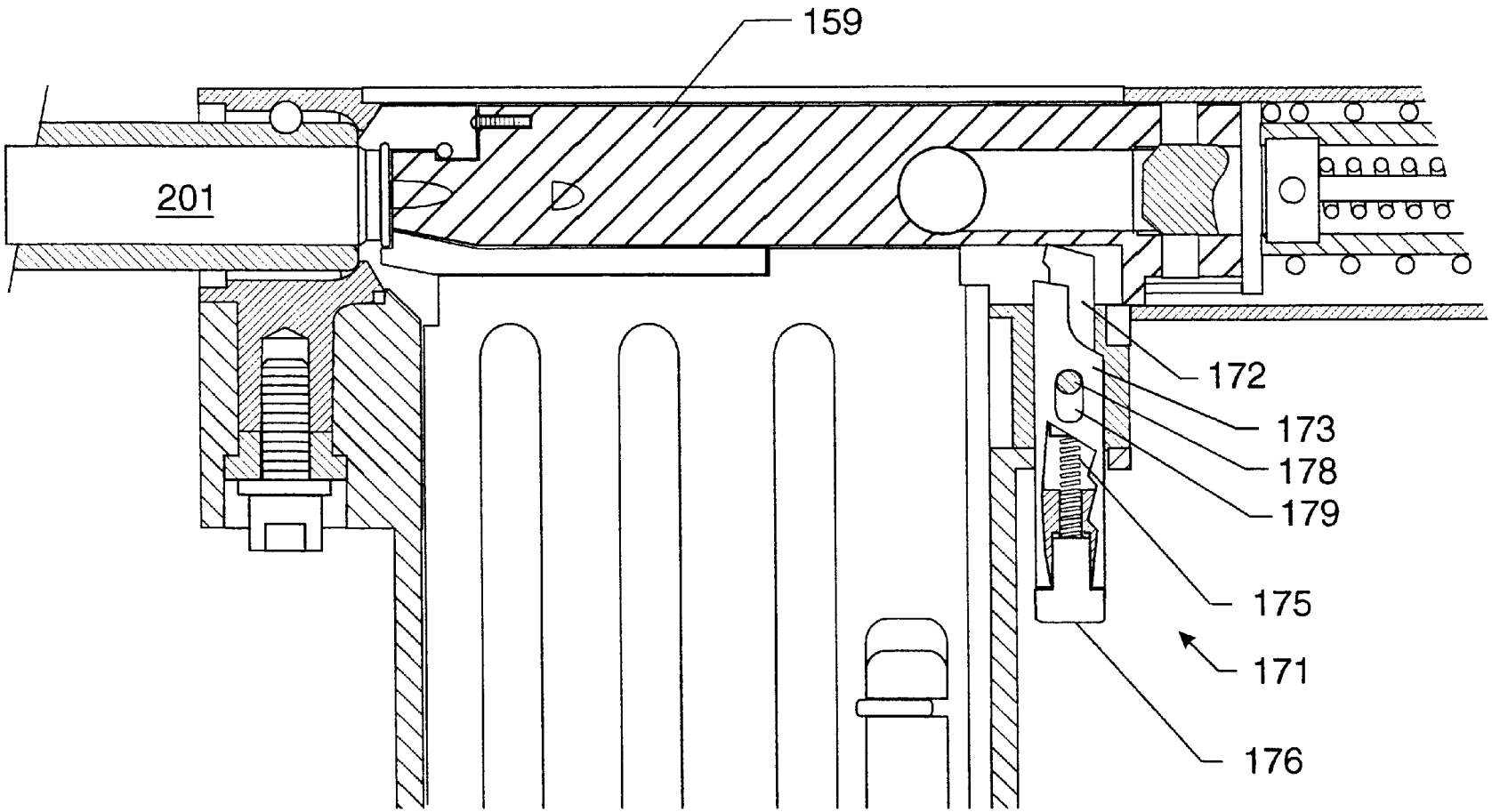
FIG. 21 is partial cross-sectional top view, as taken along lines XXI—XXI of FIG. 6, of the combination bolt lock and cartridge ejector in the forward position with the shell in the chamber.

Referring now to FIG. 21, the operation of combination bolt lockback and cartridge ejector mechanism 171 may be seen in relation to operating bolt assembly 159. As depicted in this figure, bolt assembly 159 is in forward position with cartridge 201 in the firing position. Cartridge ejector 172 with bolt assembly 159 in the forward position, is pushed outward by the bolt (down in the Figure) away from the centerline of bolt assembly 159. Cartridge ejector 172 slides along a slot in bolt assembly 159. As bolt assembly 159 is retracted, a beveled section of the slot allows ejector 172 to slide inward toward the center of bolt assembly 159. Bolt lock 176 is shown having bolt-engaging end 173 and an elongated hole 179, the entire assembly held in place by pin 178. A single spring 175 insures that ejector 172 remains snug against the bottom of the slot. Spring 175 is contained within the tubular bolt lock 176 and cartridge ejector 172 slideably fitted into a slot in the bolt lock 176, thereby depressing spring 175. Both the bolt lock 176 and the cartridge ejector 172 have elongated holes for receiving pin 178. By this arrangement, a single spring 175 provides both the bolt lock disengaging force and the engaging force for the cartridge ejector.

Figure 22:
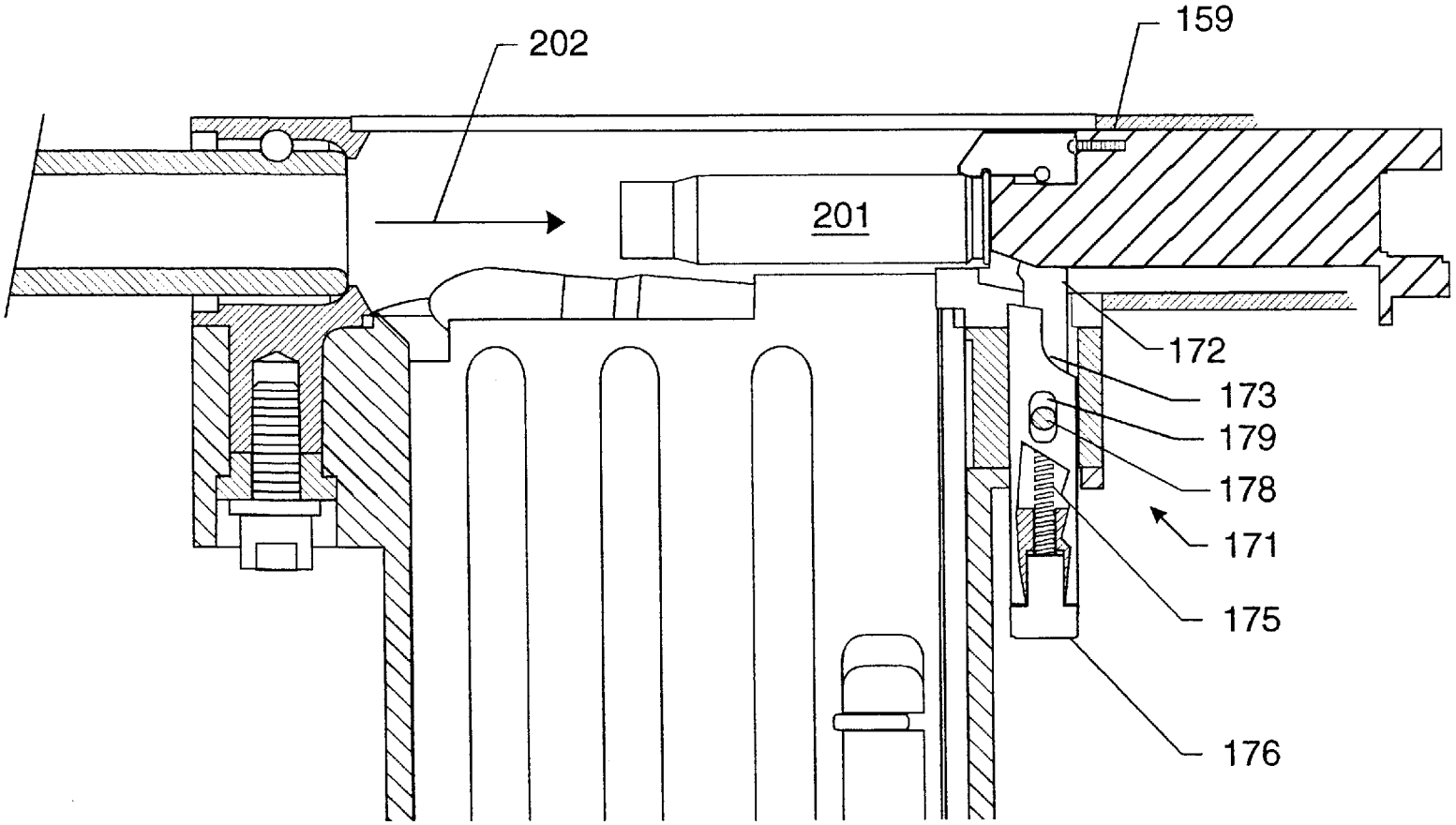
FIG. 22 is a view similar to FIG. 21, of the combination bolt lock and cartridge ejector moving to a rearward position and extracting the cartridge.

This action is more clearly depicted in FIG. 22 wherein bolt assembly 159 is shown moving to the rearward position, as depicted by arrow 202, and ejector 172 is beginning to extend inward to engage spent cartridge 201. Single ejector and locking spring 175 urges ejector 172 toward the center of bolt assembly 159. The single ejector and locking spring 175 provides dual functions for combination bolt lockback and cartridge ejector mechanism 171, providing a releasing spring force against bolt lock 176 and an inward pressure on the ejector 172. The elongated hole 179 on bolt lock 176, a hollow cylindrical tube having a slot on the rearward edge, allows the bolt lock 176 to move in and out on pin 178. The bolt lock 176 has a slot for ejector 172 and beveled shoulders on the bolt-engaging end 173. Although not shown in this cross-sectional view, it also has an elliptical hole for pin 178 identical to the elliptical hole shown in ejector 172.

Figure 23:
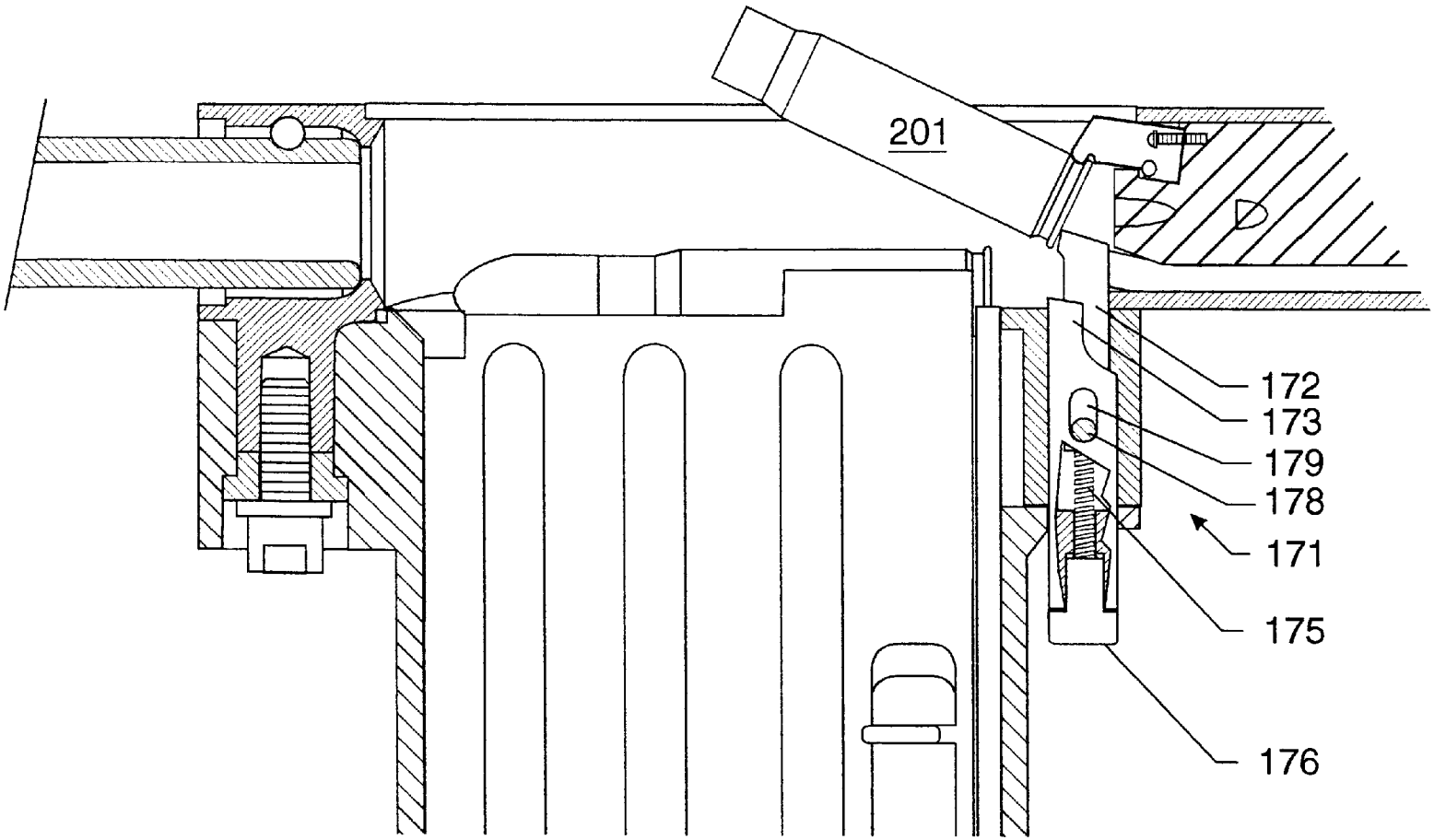
FIG. 23 is a view similar to FIG. 22, of the combination bolt lock and cartridge ejector with the spent cartridge ejecting out and a new round entering the chamber.

Referring now to FIG. 23, spent cartridge 201 is being ejected, and the combination bolt lockback and cartridge ejector mechanism 171 is shown with cartridge ejector 172 in the fully extended position. Further extension of ejector 172 is prevented by elongated hole 179 located at pin 178. As seen in FIG. 23, single spring bolt lock and cartridge ejector spring 175 is in its most extended position. Lock back 176 and bolt-engaging end 173 are shown in the fully unlocked position.

Figure 24:
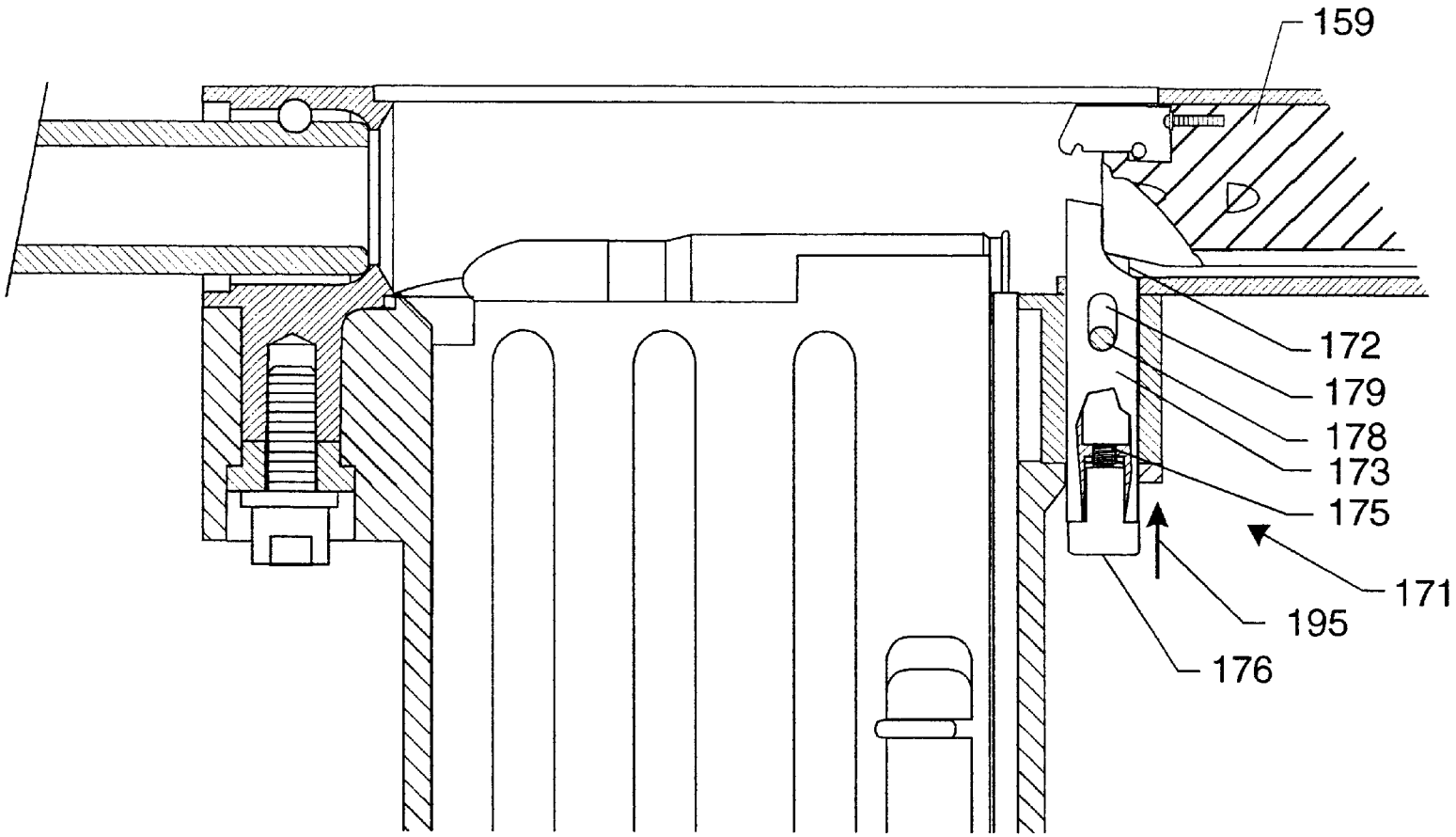
FIG. 24 is a view similar to FIG. 23, of the combination bolt lock and cartridge ejector with the bolt locked open.

Referring now to FIG. 24, with bolt assembly 159 held in the full aft position, bolt-engaging end 173 of combination bolt lockback and cartridge ejector mechanism 171 may be engaged by depressing bolt lock 176 as shown by arrow 195. Moving bolt lock 176 inward compresses single spring bolt lock and cartridge ejector spring 175 and moves lock 176 to the full travel of elongated hole 179 at pin 178. A small portion of cartridge ejector 172 can be seen near the end of bolt 159.

Figure 25:
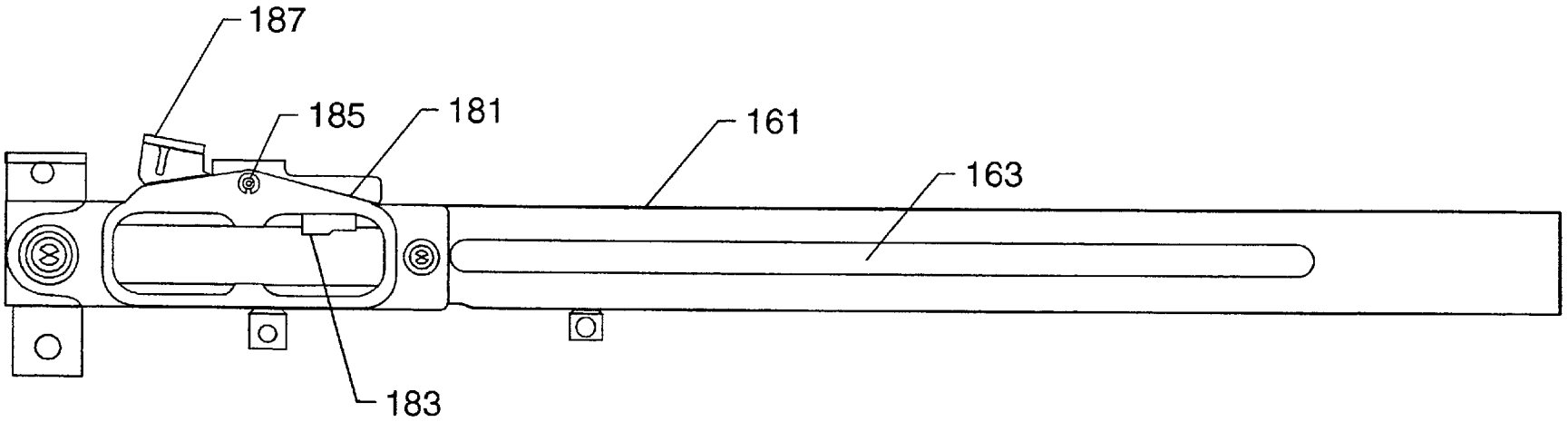
FIG. 25 is an isolated side view of the magazine well assembly.

Referring now to FIG. 25, magazine well 181 is shown with magazine locking mechanism 187. The magazine locking mechanism 187 rotates around pivot pin 185 when pressed downward, thereby lifting lock 183 and releasing an expanded magazine after firing. Bolt operating slot 163 is shown in main spring receiver tube 161 for reference purposes.

Figure 26:
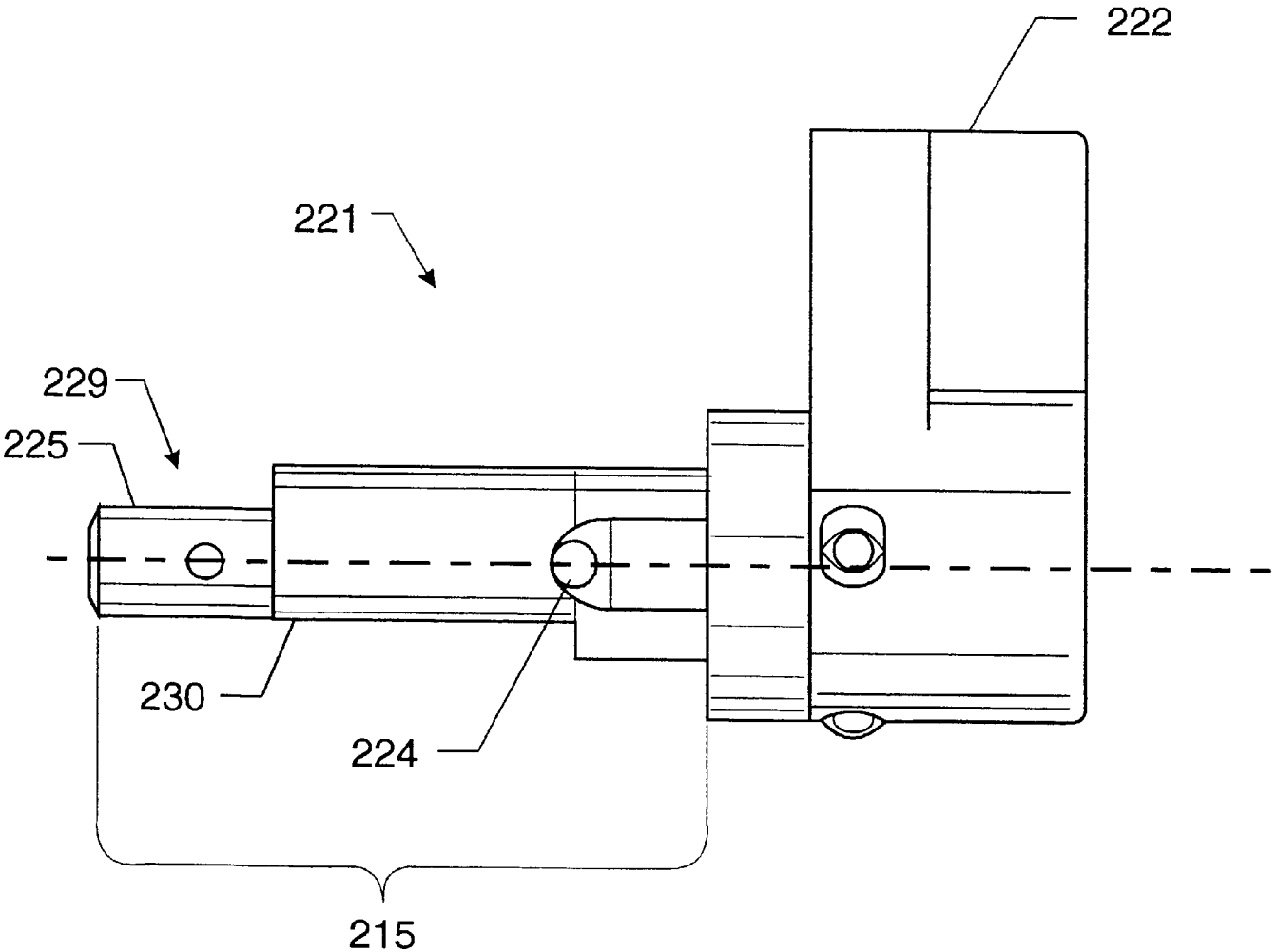
FIG. 26 is an isolated side view of the combination pin.

Referring now to FIG. 26, the combination pin, (designated generally by the reference numeral 221), attaches trigger frame cover 205 to trigger frame 211 (neither shown in this figure). Additionally, rotation of pin 221 safes and arms the weapon. Combination pin 221 comprises a handle 222 attached to a retainer pin and cam assembly 215, retainer pin 225 having a ball-locking mechanism 229. Safing cam 230 provides an eccentric movement during rotation in order to enable the trigger assembly. At the end of cam 230 nearest the handle, a detent-engagement mechanism 224 is affixed.

Figure 27:
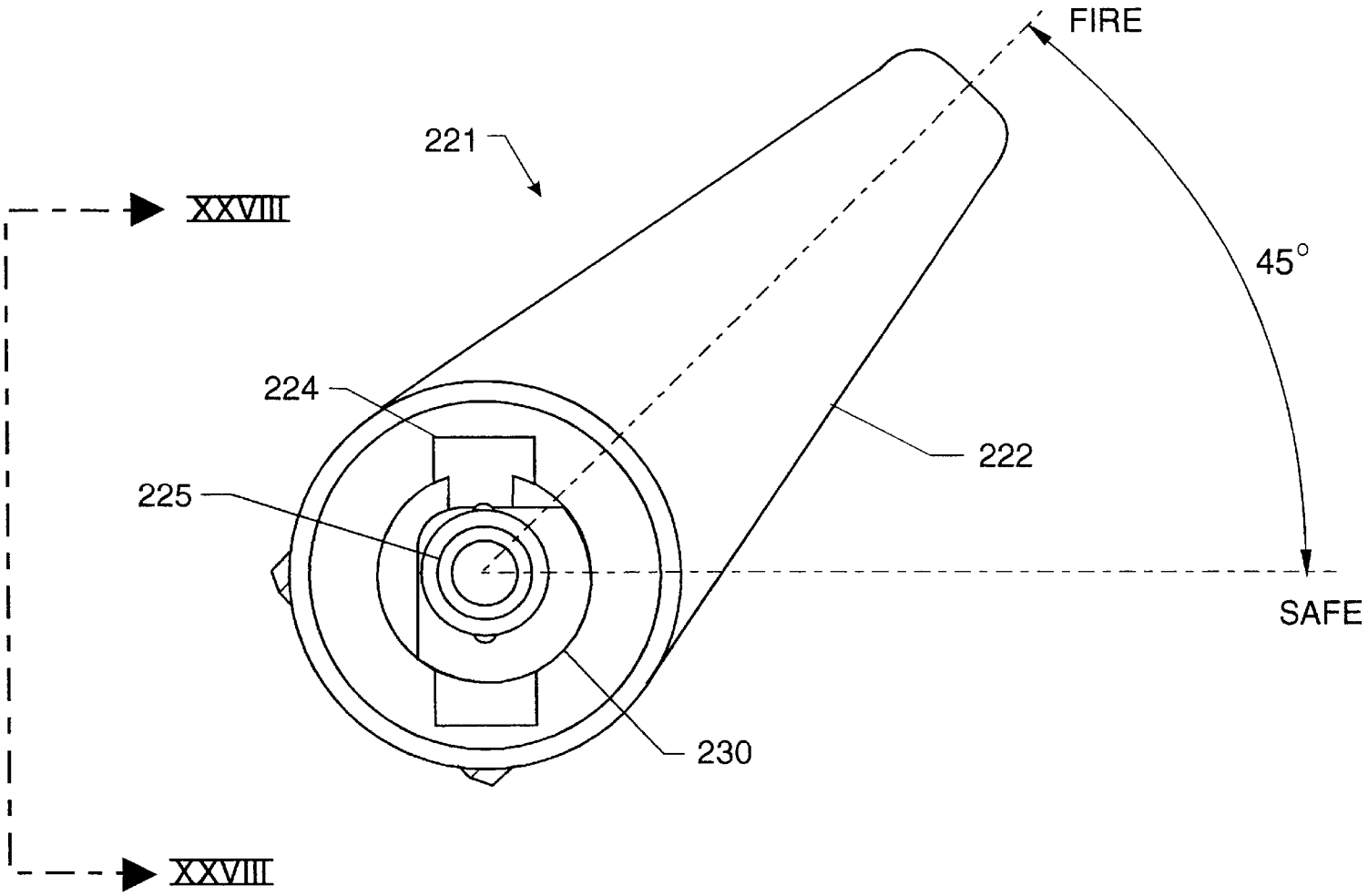
FIG. 27 is an end view of the combination pin of FIG. 26.

The shape of combination pin 221 components may be further understood by reference to FIG. 27. Handle 222 is fixed to cam 230 so that extended part of cam 230 covers a one-half circle on the lower right side of handle 222. With handle 222 in this position, safety detent engagement mechanism 224 is at the top location, 450 away from center line of handle 222 and located on the non-cam side of retainer pin 225.

Figure 28:
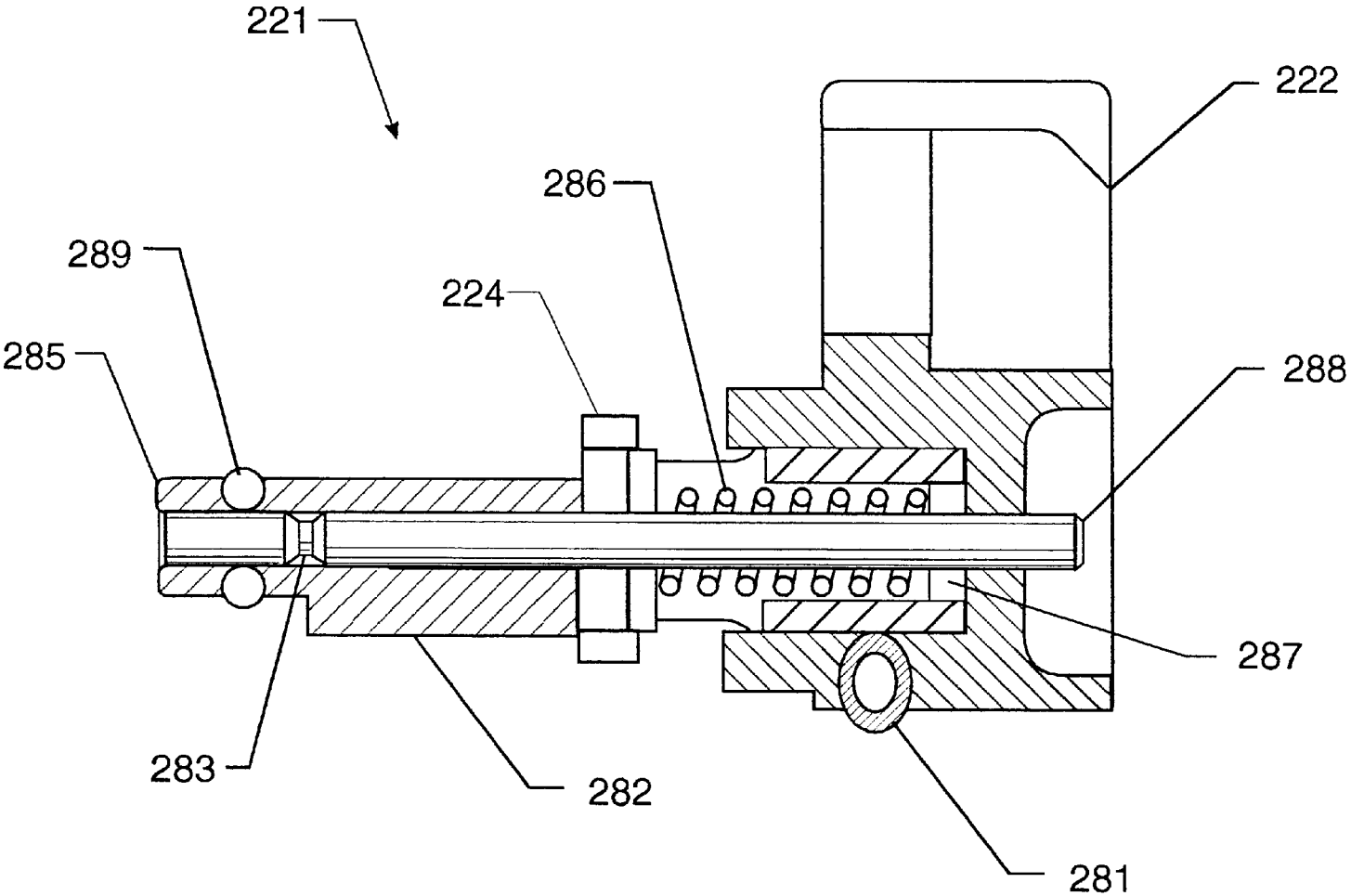
FIG. 28 is a cross-sectional view as taken along lines XXVII—XXVII of FIG. 27 of the combination pin of FIG. 26.

Referring now to FIG. 28, a cross-sectional view of combination pin 221 shows the internal mechanism with ball locking mechanism. Handle 222 is attached to retainer pin and cam assembly 282 and is held in place by spring pin 281. Retaining pin and cam assembly 282 extends from inside handle 222 to insertion end 285 of pin 221. Retainer pin and cam assembly 282 is a single piece housing having a smaller center bore at insertion end 285 and a larger center bore opposite handle end. Slots 283 are cut into ball-locking rod 288 to allow movement of locking balls 289. A dual-action spring 286 presses the detent-engagement mechanism 224 (see FIG. 26) toward insertion end 285 of combination pin 221. Dual-action spring 286 also presses against washer 287 which is affixed to ball-locking rod 288. This action urges ball-locking rod 288 toward the handle end of combination pin 221. With ball-locking rod 288 in the position shown (outward toward the handle), locking balls 289 cannot retract and combination pin 221 is held in place to secure trigger frame cover 205 to trigger frame 211 (neither shown in this view). When ball-locking rod 288 is pressed inward from trigger frame 211, handle 222 and locking balls 289 are aligned with slots 283 in ball-locking rod 288, thereby releasing the pin. The entire combination pin 221 can then be removed from the trigger assembly.

Figure 29:
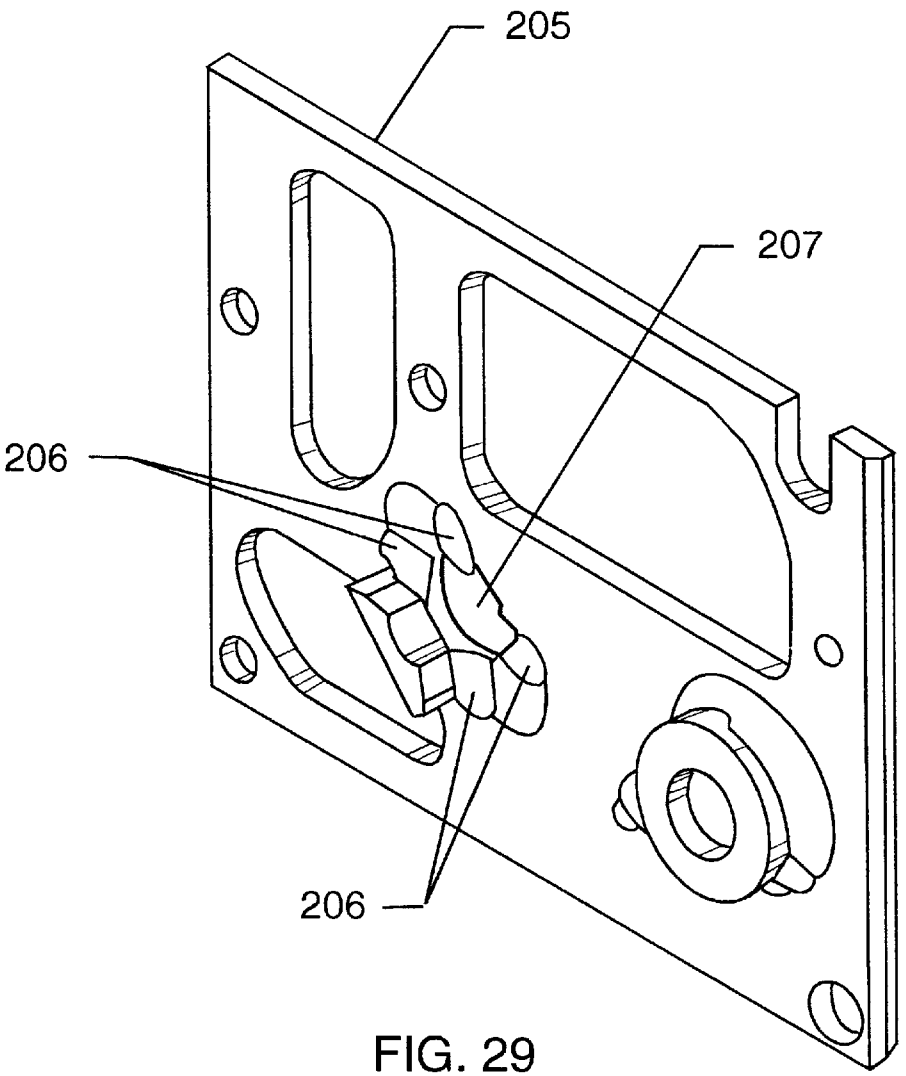
FIG. 29 is an isolated perspective view of a trigger housing plate.

FIG. 29 shows a trigger frame cover 205 which mates with combination pin 221 (shown in FIG. 28) to provide detents 206 for detent-engagement mechanism 224 (shown in FIG. 28). Aperture 207 is shaped to match the cam shape of combination pin 221, thereby allowing insertion of the combination pin only in the safe position. Due to the rotational position of the detent engagement mechanism 224 with respect to safing cam 230, when the combination safing and assembly pin 221 is aligned with the aperture 207 so that it can be inserted, the safing cam 230 is not supporting the forward position of connector link 217 (shown in prior views). After insertion, the combination safety and assembly pin 221 (shown in FIGS. 26 and 27) may be rotated to cause the safing cam 230 to raise the forward portion of the connector link 217 thereby arming the weapon.

Figure 30:
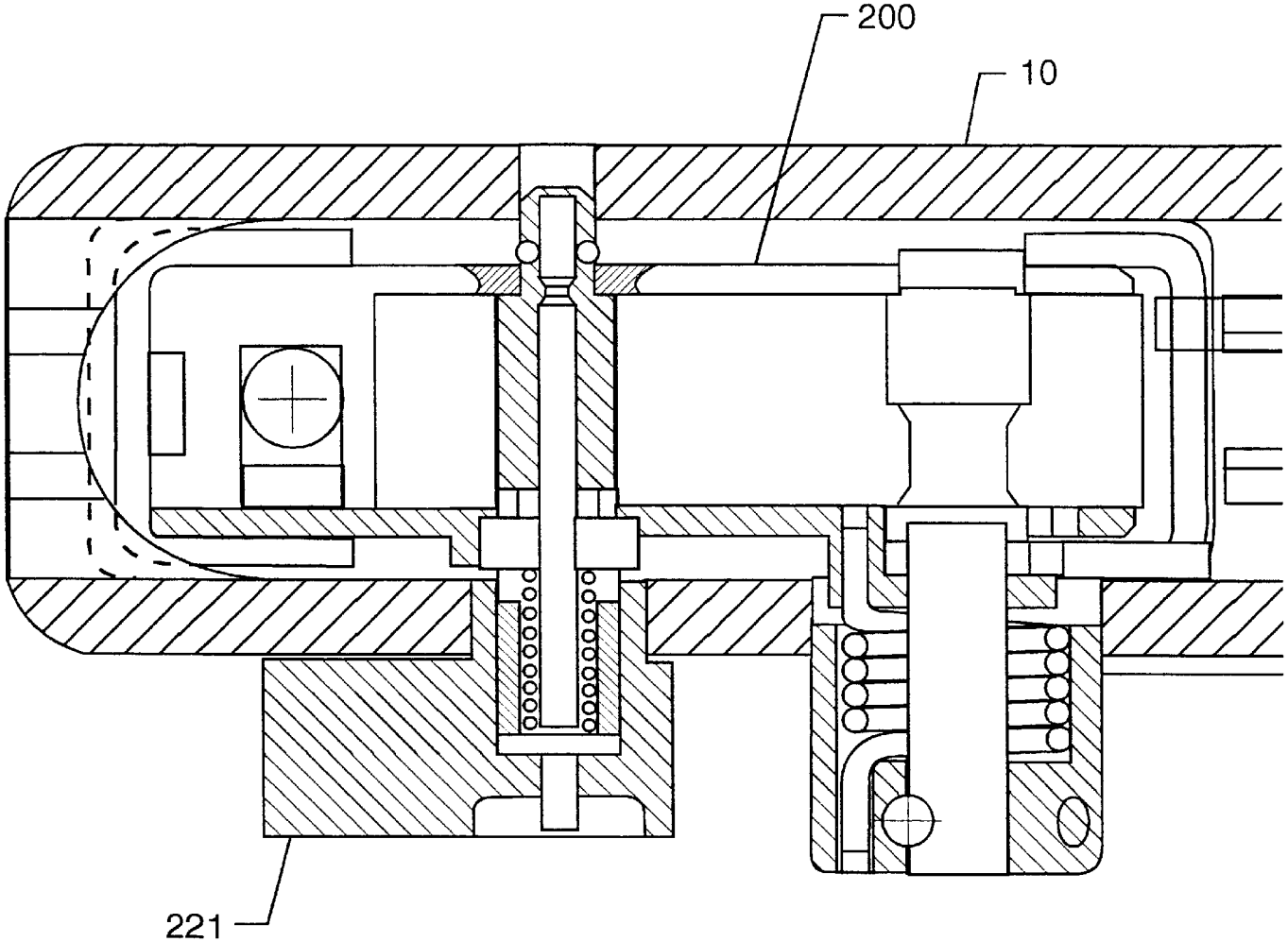
FIG. 30 is a cross-sectional top view as taken along lines XXX—XXX of FIG. 6, showing the combination pin installed in a trigger assembly.

Referring now to FIG. 30, combination pin 221 is shown inserted in trigger assembly 200 of weapon 10. Trigger assembly 200 is inserted into the weapon from the bottom and combination pin 221 is then inserted from the side, as shown. As the cam action of pin 221 is required to enable the weapon, the weapon is safe whenever pin 221 is removed. Additionally, due to the shape of aperture 207 (as seen in FIG. 29), combination pin 221 must be inserted in the safe position and fully seated before it can be rotated to the arm position. This feature means that the safety of emergency field disassembly of the weapon is greatly enhanced.

OPERATION OF THE INVENTION

The operation sequence of the weapon illustrates many of the features. The shoulder-laundered multiple-purpose assault weapon is laterally balanced and may rest on the shoulder with only a one-handed grip by the gunner. The gunner can insert a magazine of spotting ammunition without removing the weapon from the firing position, the entire weapon weighing on the order of 20 lbs. Thereafter, the gunner can fire spotting rounds in a semiautomatic mode while making final sight adjustments. When ready to launch the rocket, the thumb selector lever above the pistol grip is held down and the trigger is depressed. In this mode, the secondary hammer fires which causes the one pulse generator to produce a firing charge for rocket ignition. After firing, the weapon may be grounded by laying it on its right side, which is a "clean" side having no components mounted on that side. A single operator can fire and reload at the same pace as the conventional gunner and assistant teams. Should the gunner need weapon support during firing the built-in rest extending between the grips provides a lighter and already ready alternative to the folding bi-pod.

The benefits and novel features of the invention are numerous. A single trigger operates two separate hammer types necessary for firing either the spotting rifle or the main launcher tube. Selection between the weapons firing is accomplished by a simple depressible thumb selector lever. The mechanism allows repeated firing of the spotting rifle, but precludes further firing after the main munition is expended (until reloading the main munitions). The spotting round barrel axis can be quickly and easily aligned with the launcher tube and can achieve a high level of precision in the alignment. Neither a firing of the spotting rifle or the rocket tube, nor a changing in heat or temperature of any part alter the alignment. Any longitudinal expansion is compensated for by compression of the spring retainer in the conical gripping collar. The split conical gripping collar compensates for any cross-sectional expansion of the barrel. All of these movements or expansions can take place while maintaining a precise alignment. Additionally, the common radiused surfaces on either end of the barrel allow the barrel to be rotated through a small arc necessary to make the adjustments while maintaining a perfect mate with the receiver. The combination pin provides a dual function, both safing the trigger housing and securing it to the weapon. Additionally, the single operating spring performs a dual function, both engaging the position detent and operating the ball lock mechanism. Further, removal of the pin automatically safes the trigger housing, thereby preventing inadvertent firing during assembly or disassembly of the weapon. The dual functions serve to reduce the number and cost of parts, simplify the design, and improve reliability.

The combination bolt lockback and cartridge ejector mechanism provides a simple mechanical device which has a high degree of reliability under extreme adverse conditions of dirt, dust, mud and water contamination. The single operating spring performs both the functions of operating the lock and the ejector. The reduced part count increases reliability, decreases weight, and reduces the cost of the weapon. The breech bolt and locking mechanism has a reduced parts count, has fewer operating parts, has no engaging locking device and as a result is less expensive and more reliable. Further, the new bolt and lock assembly can operate with any type of cartridge. There is no requirement for the expensive dual cartridge design currently in use. The invention allows the gunner (of a weapon to which this invention is attached) to quickly switch from an iron sight with a large field of view to a high-powered optical sight with a confined field of view without loss of weapon aim. It also allows the gunner to switch instantly to the iron sight in the event of optical sight failure such as sight fogging. Further, the dual mounting structure of the adjustable sight mounting bracket provides a first and second mounting structure which allow both the iron sight and the optical sight to be bore-sighted at a particular range and thereafter to have a single adjustment point to adjust both the optical sight and the iron sight for either elevation or windage. Additionally, the adjustable sight mounting bracket allows the use of a less expensive non-adjustable optical scope as the adjustable bracket itself can provide alignment of the scope. Thereafter, the iron sights can be aligned using the iron sight adjustments. Further adjustment for both sights can then be made as described for target range or windage changes.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by letters patent of the united states is:

1. A shoulder-launched multi-purpose assault weapon comprising:

a receiver for a spotting rifle adapted to serve as a mounting base;

a trigger housing attached to said receiver;

a trigger housing frame adapted for attachment to the spotting rifle;

a trigger rotatably mounted within said housing;

a connector link pivotally mounted to said trigger, said trigger having a first lug at a first end for engagement of a primary sear and a second lug at a second end for engagement of a secondary sear;

a selector lever rotatably mounted on said housing frame and engaging said connector link with an eccentric cam section thereby providing a position control of said connector link;

a primary sear pivotally attached to said trigger housing frame and engaging said connector link;

a primary hammer rotatably connected to said trigger housing frame and engaging said primary sear;

a primary hammer spring connected to said hammer on a first end and having a second end for connection to a connector link spring lever;

a connector link spring lever engaging and operated by said primary hammer spring and further engaging said connector link thereby providing a downward impetus to the second end of said connector link and urging said link against the selector lever;

a secondary sear prop rotatably attached to said trigger housing frame and engaging the second end of said connector link;

a secondary sear rotatably mounted in the stock attached to and engaging said sear prop;

a secondary hammer slideably mounted to the trigger housing and engaging said secondary sear;

a barrel retaining pin attached to said receiver and a center ring bracket and further securing said spotting rifle barrel to said receiver;

a muzzle clamp ring bracket assembly for attaching the muzzle of the spotting rifle barrel to a rocket launcher tube;

a hollow cylindrical bolt lockback inserted through said trigger housing and having an upper slot and a lower slot and having beveled shoulders on a bolt-engaging end;

an operating spring inserted inside said hollow cylindrical bolt lockback;

a cartridge ejector having a slot and being inserted into said hollow cylindrical bolt lockback and thereby compressing said operating spring;

a retainer spring inserted through the slots of both said bolt lockback and said cartridge ejector;

a bolt housing attached to said fixed receiver having a cylindrical shape;

a first spring contained within said bolt housing;

a two-part bolt assembly having an outer cylindrical bolt slideably positioned within said bolt housing and operated by said first spring and having an inner bolt and pin mechanism slideably positioned within said outer cylindrical bolt; and a second spring positioned within said outer cylindrical bolt and enclosing said inner bolt and pin assembly and further urging said inner bolt and pin assembly toward the firing position.

2. A shoulder-launched multi-purpose assault weapon comprising:

a spotting rifle including an assembly comprising a spotting round bore alignment mechanism, dual-function subassemblies for assembly and safing, for cartridge ejecting and bolt locking back, a dual-function trigger assembly having a single trigger connected to a means for selectively operating a primary hammer and a secondary hammer, and also having a means for locking out further trigger operation after operating said secondary hammer, and a dual spring breech bolt and lock assembly;

a detachable rocket tube mounted on the top of said spotting rifle assembly; and a combination optical and open sight forming a single assembly attached to said detachable tube, such single assembly having adjusting knobs which adjust the aiming of both optical and open sights simultaneously.

3. A shoulder-launched multi-purpose assault weapon as in claim 2 wherein said dual function trigger assembly further comprises:

a trigger housing adapted for attachment to the spotting rifle;

a connector link pivotally mounted to said single trigger, said trigger having a first lug at a first end for engagement of a primary sear and a second lug at a second end for engagement of a secondary sear;

a selector lever rotatably mounted on said housing and engaging said connector link with an eccentric cam section thereby providing a position control of said connector link;

a primary sear pivotally attached to said trigger housing frame and engaging said connector link;

a primary hammer spring connected to said primary hammer on a first end and having a second end for connection to a connector link spring lever;

a connector link spring lever engaging and operated by said primary hammer spring and further engaging said connector link thereby providing a downward impetus to the second end of said connector link and urging said link against the selector lever;

a secondary sear prop rotatably attached to said trigger housing frame and engaging the second end of said connector link;

a secondary sear rotatably attached outside said housing frame and engaging said secondary sear prop; and a secondary hammer slideably mounted outside said housing and engaging said secondary sear.

4. A shoulder-launched multi-purpose assault weapon as in claim 2 wherein said dual-function trigger assembly further comprises:

means for housing said trigger assembly;

a primary sear connected to said trigger assembly and engaging said primary hammer which is a rotating hammer;

a secondary sear connected to said trigger assembly and engaging said secondary hammer which is a plunger hammer;

a connector link rotatably mounted on the trigger and having a first end with a first engaging lug and a second end with a second engaging lug; and a selector lever rotatably mounted to said means for housing, said selector lever having a cam section for engaging said connector link.

5. A shoulder-launched multi-purpose assault weapon as in claim 4 including means for alternately operating the primary and secondary sear which comprises a connector link spring lever rotatably mounted on said means for housing and urging the second end of said connector link in a downward direction towards said selector lever.

6. A shoulder-launched multi-purpose assault weapon as in claim 5 wherein said connector link spring lever engages and is operated by a primary hammer spring.

7. A shoulder-launched multi-purpose assault weapon as in claim 6 wherein said means for alternately operating the primary and secondary sears further comprises a secondary sear prop rotatably mounted on said means for housing.

8. A shoulder-launched multi-purpose assault weapon as in claim 2 wherein said dual-function trigger assembly further comprises a means for selectively operating a rotating type hammer and a piston type hammer.

9. A shoulder-launched multi-purpose assault weapon as in claim 2 wherein said spotting round bore alignment comprises:

means for attaching a spotting cartridge rifle barrel to a rocket launcher tube;

means for supporting a muzzle end of a spotting rifle barrel, said means connected to said attaching means;

a fixed receiver for a spotting rifle attached to said means for attaching; and an adjustable spotting rifle barrel having a muzzle end and a breech end, said breech end having a spherical mating surface for mating with said fixed receiver and said muzzle end having a spherical surface to mate with means for attaching.

10. A shoulder-launched multi-purpose assault weapon as in claim 9 wherein said means for attaching comprises a receiver bracket having a clamp ring for attachment to a rocket launcher tube.

11. A shoulder-launched multi-purpose assault weapon as in claim 9 wherein said fixed receiver has a concave conical surface for mating to said spotting rifle barrel.

12. A shoulder-launched multi-purpose assault weapon as in claim 9 wherein said adjustable rifle barrel has a spherical mating surface having a radius center located at longitudinal distance from the breech end of the barrel approximately equal to the outside radius of the spotting barrel.

13. A shoulder-launched multi-purpose assault weapon as in claim 9 wherein said means for supporting the muzzle end of the spotting rifle barrel comprises a bracket assembly attached to the rocket launcher tube.

14. A shoulder-launched multi-purpose assault weapon as in claim 9 wherein said means for supporting further comprises a barrel locating bushing, barrel collar, and jam nut attached to said bracket assembly.

15. A shoulder-launched multi-purpose assault weapon as in claim 14 wherein said means for supporting includes a plurality of adjustment screws threaded through and located around the circumference of said locating bushing.

16. A shoulder-launched multi-purpose assault weapon as in claim 15 wherein said supporting means includes a locating washer, collar and spring assembly fitted around the spotting rifle barrel.

17. A shoulder-launched multi-purpose assault weapon as in claim 16 wherein said locating washer has a muzzle end surface for mating to said barrel collar.

18. A shoulder-launched multi-purpose assault weapon as in claim 17 wherein said locating washer has a muzzle end surface having a spherical shape.

19. A shoulder-launched multi-purpose assault weapon as in claim 18 wherein said locating washer has a spherical surface having a radius center located at the center and near the breech end of said spotting rifle barrel approximately one outside barrel radius from the breech end.

20. A shoulder-launched multi-purpose assault weapon as in claim 2 wherein said weapon comprises a spotting round bore alignment mechanism for a rocket launcher further comprising:

a ring bracket assembly for attaching a spotting rifle receiver to a rocket launcher tube, said receiver having a concave conical surface for mating with a spotting rifle barrel;

a spotting rifle barrel mated to said receiver having spherical breech shoulders and muzzle end retaining shoulders;

a barrel retaining pin attached to said receiver and ring bracket and further securing said spotting rifle barrel to said receiver;

a muzzle ring bracket assembly for attaching the muzzle of the spotting rifle barrel to a rocket launcher tube;

a locating washer, grip collar and spring assembly mating said spotting rifle muzzle shoulders and engaging said locating washer having a spherical surface for engagement of said muzzle ring bracket assembly; and adjustment screws threaded through said muzzle bracket assembly and providing an adjustment to align the spotting rifle barrel axis with the rocket launcher tube.

21. A shoulder-launched multi-purpose assault weapon as in claim 2 wherein said dual-function subassembly for assembling and safing is a combination pin comprising:

a handle;

a single means, attached to said handle, for attaching and safing a trigger assembly; and means for securing and releasing said combination pin.

22. A shoulder-launched multi-purpose assault weapon as in claim 21 wherein said single means comprises a retainer pin and cam assembly.

23. A shoulder-launched multi-purpose assault weapon as in claim 22 wherein said retainer pin and cam assembly further comprises a single piece housing having an insertion end and a handle end and having a smaller center bore at the insertion end and a larger center bore at the handle end and having transverse slots through the pin.

24. A shoulder-launched multi-purpose assault weapon as in claim 23 wherein said retainer pin and cam assembly further comprise a detent engagement mechanism slideably located within said retainer pin and cam assembly.

25. A shoulder-launched multi-purpose assault weapon as in claim 24 wherein said retainer pin and cam assembly further comprises a dual-action spring urging said detent engagement mechanism toward the insertion end of said retainer pin and cam assembly.

26. A shoulder-launched multi-purpose assault weapon as in claim 25 wherein said retainer pin and cam assembly further comprises a locking rod slideably located in the center bore of said pin.

27. A shoulder-launched multi-purpose assault weapon as in claim 2 wherein said dual-function subassembly for assembling and safing comprises a combination pin for attaching and safing a small arm trigger assembly further comprising:

a retainer pin and cam assembly having an insertion end and a handle end and having a smaller center bore on the insertion end and a larger center bore on the handle end;

a plurality of locking balls located in apertures on said retainer pin and cam assembly;

a locking rod having an insertion end and a handle end inserted into the center bore of said retainer pin and cam assembly.

a washer attached to said locking rod near the handle end of said rod;

a detent engagement mechanism slideably engaging said locking rod;

a dual-action spring installed over said locking rod and further located with the larger center bore section of said retainer pin and cam assembly;

a handle affixed to said retainer pin and cam assembly; and a spring pin located in said handle and securing said handle to said retainer pin and cam assembly.

28. A shoulder-launched multi-purpose assault weapon as in claim 2 wherein said dual function subassembly for cartridge ejecting and bolt locking back comprises:

a hollow cylindrical bolt lockback having an upper slot and a lower slot and having beveled shoulders on a bolt-engaging end;

an operating spring inserted inside said hollow cylindrical bolt lockback;

a cartridge ejector having a slot and being inserted into said hollow cylindrical bolt lockback and thereby compressing said operating spring; and a pin inserted through the slots of both said bolt lockback and said cartridge ejector and adapted for attachment to the spotting rifle assembly.

29. A shoulder-launched multi-purpose assault weapon as in claim 2 wherein said dual function subassembly for cartridge ejecting and bolt locking back comprises:

means for locking back a bolt in a rearward position;

means for ejecting a cartridge inserted into said means for locking back;

a single spring located within said means for locking back, said spring operating both said means for locking back and said means for ejecting; and means for retaining said locking back and said ejecting means as an operating mechanism attached to said spotting rifle.

30. A shoulder-launched multi-purpose assault weapon as in claim 29 wherein said means for locking back comprises a hollow cylindrical bolt lockback having a slot on an upper surface and a slot on a lower surface and further having a beveled shoulder on a bolt-engaging end.

31. A shoulder-launched multi-purpose assault weapon as in claim 30 wherein said means for ejecting comprises an ejector having a slot.

32. A shoulder-launched multi-purpose assault weapon as in claim 31 wherein said means for retaining comprises a pin inserted into the slots of both said hollow cylindrical bolt lockback and said ejector.

33. A shoulder launched multi-purpose assault weapon as in claim 2 wherein said breech bolt and lock assembly further comprises:

a bolt housing having a cylindrical shape;

a first spring contained within said bolt housing;

a two-part bolt assembly having an outer cylindrical bolt slideably positioned within said bolt housing and operated by said first spring and having an inner bolt and pin mechanism slideably positioned within said outer cylindrical bolt; and a second spring positioned within said outer cylindrical bolt and enclosing said inner bolt and pin assembly and further urging said inner bolt and pin assembly toward the firing position.

34. A shoulder launched multi-purpose assault weapon as in claim 33 wherein said inner bolt and firing pin mechanism comprises a weighted cylindrical firing pin having a pointed center for engaging a cartridge.

* * * * *